US007226891B2

(12) United States Patent
Nakayama et al.

(10) Patent No.: US 7,226,891 B2
(45) Date of Patent: Jun. 5, 2007

(54) IMAGE FORMING METHOD USING THERMAL TRANSFER RECORDING MATERIAL

(75) Inventors: Yoriko Nakayama, Hino (JP); Hiroshi Watanabe, Fussa (JP); Hiroaki Yamagishi, Hachioji (JP); Hirokazu Koyama, Hino (JP); Kaori Fukumuro, Hachioji (JP); Hiroki Nakane, Hachioji (JP)

(73) Assignee: Konica Minolta Photo Imaging, Inc, Tokyo (JP)

( * ) Notice: Subject to any disclaimer, the term of this patent is extended or adjusted under 35 U.S.C. 154(b) by 237 days.

(21) Appl. No.: 10/946,058

(22) Filed: Sep. 21, 2004

(65) Prior Publication Data

US 2005/0067090 A1 Mar. 31, 2005

(30) Foreign Application Priority Data

Sep. 30, 2003 (JP) ..... 2003-339571

(51) Int. Cl.
*B41M 5/38* (2006.01)

(52) U.S. Cl. ..... 503/227; 428/32.39; 428/32.51; 428/32.76

(58) Field of Classification Search ..... 503/200–227
See application file for complete search history.

(56) References Cited

FOREIGN PATENT DOCUMENTS

| | | |
|---|---|---|
| JP | 10-24662 | 1/1998 |
| JP | 11-291649 | 10/1999 |

*Primary Examiner*—Bruce H. Hess
(74) *Attorney, Agent, or Firm*—Lucas & Mercanti, LLP

(57) ABSTRACT

An image forming method containing the steps of (a) forming an image on a thermal transfer sheet of a thermal transfer recording material, and (b) transferring the image onto an image receiving sheet of the thermal transfer recording material, wherein the thermal transfer sheet including a substrate having thereon a yellow ink layer containing a thermally transferable yellow dye, a magenta ink layer containing a thermally transferable magenta dye, and a cyan ink layer containing a thermally transferable cyan dye, the image receiving sheet including a substrate having thereon a thermally transferable dye receiving layer; at least one of the thermally transferable dyes is reactive with a dye fixing agent, and satisfies Formula of $(Aa/Am)\times100\geqq75$; and a printing rate of each of the yellow ink layer, the magenta ink layer and the cyan ink layer is not more than 2.5 msec./line.

18 Claims, 1 Drawing Sheet

IMAGE FORMING METHOD USING THERMAL TRANSFER RECORDING MATERIAL

FIELD OF THE INVENTION

The present invention relates to an image forming method using a thermal transfer recording material for recording an image by a thermal transfer recording method, particularly, to an image forming method using a thermal transfer recording material which-exhibits improved image storage stability and improved image-lasting properties.

BACKGROUND OF THE INVENTION

As a color or monochrome image forming technology, known has been an image forming technology in which an ink sheet containing thermally transferable dyes featuring diffusion transition characteristics by application of heat, were an image is transferred onto an image receiving layer, facing the ink sheet to the image receiving layer of a image receiving sheet, using a heat printing means such as a thermal head or a laser. This thermal transfer method enables image formation from digital data, and has a reputation for high image quality comparable to silver salt photography, without using processing solutions such as a developing solution.

However, regarding image storage stability and durability of the obtained images, there are drawbacks such as being inferior to conventional silver salt photography. Specifically, the following inferior characteristics are known.

The problems are:

1) During long period storage, discoloration and bleeding of images are caused by light, heat, oxygen and ambient moisture, that is, unacceptable light stability and heat resistance.

2) In cases when images are contacted with a material having high dyeing properties or containing a plasticizer such as album sheets, clear file sheets and plastic pencil erasers, dyes are reverse transferred to these materials or bleed upon contact during long term storage, that is, they exhibit low plasticizer resistance.

3) When water, juices, alcohol beverages, or coffee is spilled on formed images and wiped away, dyes are also wiped off whereby discoloration occurs, exhibiting lack of water resistance and solvent resistance.

4) Discoloration also occurs due to skin oil when fingers touch the images, that is, low sebum resistance.

5) The images are damaged when rubbed by an eraser, that is, lack of abrasion resistance.

6) When the images are laminated with a commercially available laminate material, specifically with a low temperature laminating material, dyes diffuse to the laminate material and cause bleeding during long term storage, that is, poor laminatability.

The reasons for these problems are assumed to be that the dyes employed in a thermal transfer recording material are primarily dispersed in a binder, and tend to be directly affected by external influences, contrary to the dyes employed in silver salt photography which are protected by high boiling point solvents and UV absorbing agents.

As a means to overcome the foregoing drawbacks, several image forming methods to react with compounds in an ink layer with compounds in a image receiving layer by thermal transfer are proposed, to be an image forming method employing a so-called reactive dye. At this point, a compound contained in an ink layer is defined as a dye precursor, and a compound contained in an image receiving layer is defined to be a dye fixing agent. For example, proposed are image forming methods with re-protonation of a cationic dye by thermal transfer, employing a deprotonated cationic dye as a dye precursor and an organic polymer acid or an oligomer acid capable of protonating the cationic dye as a dye fixing agent, as described in Unexamined Japanese Patent Application Publication (hereinafter, referred to as JP-A) 9-327976, and U.S. Pat. Nos. 4,880,769 and 5,534,479. Further, in JP-A 5-221151, employing a certain structured dye having a reactive group as a dye precursor and a reactive hydrogen compound as a dye fixing agent, proposed are image forming methods to make them react by thermal transfer.

Further, employing a thermally diffusive dye capable of chelating as a dye precursor and a metal ion containing compound as a dye fixing agent, image forming methods to make them react to form a metal chelate are proposed (see, for example, Patent Documents 1–3).

The formed images employing this method rarely cause discoloration and bleeding of dyes even though the image receiving material, carrying images, are stored at high temperature and high humidity. Light stability of the images is superior to that of images formed using existing thermally transferable dyes. However, there have been problems that color of the images changes over time due to unreacted dyes which remain due to incomplete reaction between the dyes and the dye fixing agents in high image density areas.

The means to overcome this problem is to increase the added amount of the dye fixing agents in an image receiving layer to increase reactivity. However, this results in another problem of coloring of white background due to the coloring within the dye fixing agents. Another proposed counter method is heating the images again after thermal transfer (for example, please refer to Patent Document 4), however, this results in a problem of lowered density due to reverse transfer of the dyes in the images to an ink layer during re-heating since no dye is contained in the ink layer between the thermal head and the images.

Further, another proposed method is to provide a protective layer on the images, in which a protective layer transfer sheet having a thermally transferable protective layer is applied onto the image forming layer of an image receiving sheet, and then the protective layer is transferred using a heating means such as a thermal head or a heated roller (for example, please refer to Patent Document 5). In cases when a protective layer is provided on images, physical resistance such as the foregoing abrasion resistance, water resistance, solvent resistance, and sebum resistance of images can be enhanced. However, in order to adhere the protective layer onto the image receiving layer, it is requested to decrease the amount of dye fixing agents in the image receiving layer, resulting in lowered reactivity between the dyes and the dye fixing agents. When transfer energy of protective layer transfer is raised to counter this, the protective layer is adversely lowered in quality due to heat, resulting in surface roughness and yellowing.

Patent Document 1: JP-A 59-78893
Patent Document 2: JP-A 59-109394
Patent Document 3: JP-A 60-2398
Patent Document 4: JP-A 11-70746
Patent Document 5: JP-A 2001-246845

SUMMARY OF THE INVENTION

The present invention was achieved to counter the above problems. An object of this invention is to provide an image forming method to form images exhibiting superiority of light stability (being color stability), bleeding resistance and abrasion resistance requiring little transfer energy by using dyes exhibiting high reactivity.

The foregoing object of the present invention can be accomplished by the following embodiments.

Item 1. An image forming method comprising the steps of:

(a) forming an image on a thermal transfer sheet of a thermal transfer recording material, and (b) transferring the image onto an image receiving sheet of the thermal transfer recording material, wherein the thermal transfer sheet comprising a substrate having thereon a yellow ink layer containing a thermally transferable yellow dye, a magenta ink layer containing a thermally transferable magenta dye, and a cyan ink layer containing a thermally transferable cyan dye, the image receiving sheet comprising a substrate having thereon a thermally transferable dye receiving layer;

at least one of the thermally transferable dyes is reactive with a dye fixing agent, and satisfies Formula (1):

$$(Aa/Am)\times 100 \geqq 75 \qquad \text{Formula (1)}$$

wherein Am is an absorbance at a wavelength of an absorption maximum ($\lambda max_1$) obtained by adding 30 mol of the dye fixing agent to 1 mol of the thermally transferable dye, and Aa is an absorbance at a wavelength of an absorption maximum ($\lambda max_1$) obtained by adding 3 mol of the dye fixing agent to 1 mol of the thermally transferable dye; and a printing rate of each of the yellow ink layer, the magenta ink layer and the cyan ink layer is not more than 2.5 msec./line.

Item 2. The image forming method of item 1, wherein a thermally transferable protective layer is further provided on the substrate.

Item 3. The image forming method of item 1 or 2, wherein (Aa/Am)×100 defined by Formula (1) is 90 or more.

Item 4. The image forming method of any one items 1–3, wherein one of the thermally transferable cyan dyes is reactive with a dye fixing agent, and satisfies Formula (1).

Item 5. The image forming method of any one of items 1–4, wherein one of the thermally transferable magenta dyes and one of the thermally transferable cyan dyes are individually reactive with a dye fixing agent, and satisfy Formula (1).

Item 6. The image forming method of any one of items 1–5, wherein one of the thermally transferable yellow dyes, one of the thermally transferable magenta dyes and one of the thermally transferable cyan dyes are each reactive with a dye fixing agent, and satisfy Formula (1).

Item 7. The image forming method of any one of items 1–6, wherein at least one of the ink layers is reactive with a dye fixing agent, and contains at least two kinds of dyes, one of which is the thermally transferable dye satisfying Formula (1).

Item 8. The image forming method of item 2, wherein (Aa/Am)×100 defined by Formula (1) is 90 or more.

Item 9. The image forming method of item 2, wherein one of the thermally transferable cyan dyes is reactive with a dye fixing agent, and satisfies Formula (1).

Item 10. The image forming method of item 2, wherein the thermally transferable protective layer contains an ultraviolet ray absorbing agent.

Item 11. An image forming method comprising the steps of:

(a) forming an image on a thermal transfer recording material comprising a thermal transfer sheet, and (b) transferring the image onto an image receiving sheet, wherein the thermal transfer sheet comprising a substrate having thereon a yellow ink layer containing a thermally transferable yellow dye, a magenta ink layer containing a thermally transferable magenta dye, and a cyan ink layer containing a thermally transferable cyan dye, the image receiving sheet comprising a substrate having thereon a thermally transferable dye receiving layer;

at least one of the thermally transferable dyes is reactive with a dye fixing agent, and satisfies Formula (1):

$$(Aa/Am)\times 100 \geqq 75 \qquad \text{Formula (1)}$$

wherein Am is an absorbance at a wavelength of an absorption maximum ($\lambda max_1$) obtained by adding 30 mol of the dye fixing agent to 1 mol of the thermally transferable dye, and Aa is an absorbance at wavelength of an absorption maximum ($\lambda max_1$) obtained by adding 3 mol of the dye fixing agent to 1 mol of the thermally transferable dye; and the image is formed by sequential printing onto the ink layer in the order of the value of (Aa/Am)×100 defined by Formula (1), with the smallest value ink layer being first.

Item 12. The image forming method of item 11, wherein a thermally transferable protective layer is further provided on the substrate.

Item 13. The image forming method of item 11 or 12, wherein at least one of the ink layers is reactive with a dye fixing agent, and contains at least two kinds of dyes containing the thermally transferable dye satisfying Formula (1).

Item 14. The image forming method of any one of items 11–13, wherein the thermal transferable protective layer contains an ultraviolet ray absorbing agent.

Item 15. An image forming method comprising the steps of:

(a) forming an image on a thermal transfer recording material comprising a thermal transfer sheet, and (b) transferring the image onto an image receiving sheet, wherein the thermal transfer sheet comprising a substrate having thereon a yellow ink layer containing a thermally transferable yellow dye, a magenta ink layer containing a thermally transferable magenta dye, and a cyan ink layer containing a thermally transferable cyan dye, the image receiving sheet comprising a substrate having thereon a thermally transferable dye receiving layer;

at least one of the thermally transferable dyes is reactive with a dye fixing agent, and satisfies Formula (1):

$$(Aa/Am)\times 100 > 75 \qquad \text{Formula (1)}$$

wherein Am is an absorbance at a wavelength of an absorption maximum ($\lambda max_1$) obtained by adding 30 mol of the dye fixing agent is added to 1 mol of the thermally transferable dye, and Aa is an absorbance at a wavelength of an absorbance maximum ($\lambda max_1$) obtained by adding 3 mol of the dye fixing agent to 1 mol of the thermally transferable dye;

a printing rate of each of the yellow ink layer, the magenta ink layer and the cyan ink layer is not more than 2.5 msec./line; and the image is formed by sequential printing on the ink layer in the order of the value of (Aa/Am)×100 defined by Formula (1), with the smallest value ink layer being first.

Item 16. The image forming method of item 15, wherein a thermally transferable protective layer is further provided on the substrate.

Item 17. The image forming method of claim 15, wherein at least one of the ink layers contains at least two kinds of the thermally transferable dyes which are reactive with a dye fixing agent and are satisfying Formula (1).

Item 18. The image forming method of item 16, wherein a thermally transferable protective layer contains an ultraviolet ray absorbing agent.

Figure 1:
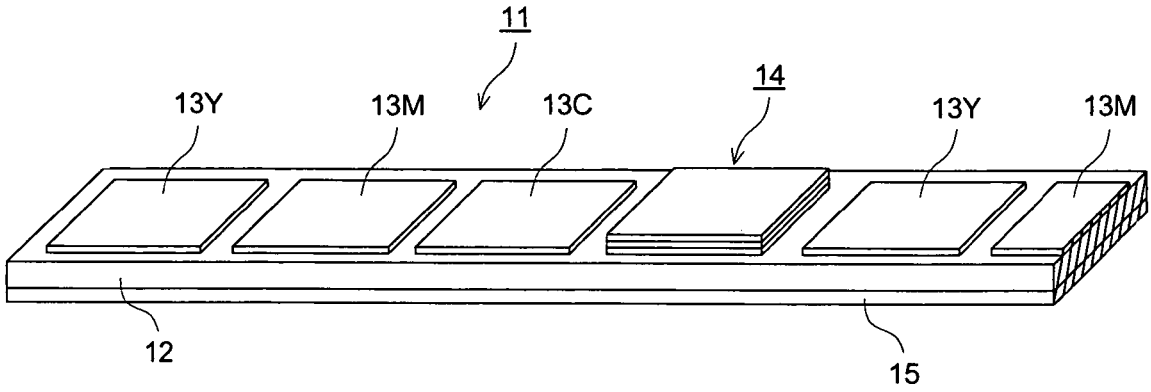
FIG. 1 is a perspective view showing an instance of a thermal transfer recording material of this invention, providing ink layers and a transferable protective layer sequentially on the same side of a substrate.

Based on the present invention, by using a dye exhibiting having high reactivity, images exhibiting excellent light stability (being color stability), bleeding resistance and abrasion resistance, can be obtained with consumption of little transfer energy. Further, due to reduced transfer energy, the printing rate increases, and thereby reduced power consumption, down sizing and portability of the printer become possible. Therefore, the present invention can provides an image forming method using a thermal transfer recording material, with which images having excellent storage stability can be obtained, by conducting image formation in printing sequence based on dye reactivity.

DESCRIPTION OF THE PREFERRED EMBODIMENTS

The preferred embodiments to conduct the present invention will be described in detail below, but the present invention is not limited to these embodiments.

The object and desired effects of the present invention are achieved by using a thermal transfer recording material which comprises a substrate having thereon an ink layer containing thermally transferable dyes, and at least one of the thermally transferable dyes is reactive with a dye fixing agent, and also satisfies Formula (1).

The details of the present invention will be described below.

Firstly, Formula (1) which defines reactivity of a thermally transferable dye with a dye fixing agent is described.

In the thermal transfer recording material of this invention, a thermally transferable dye (hereinafter, also referred to as simply a dye) used in an ink layer provided on a thermal transfer sheet exhibits a more than 75 percentage in the ratio of absorbance Am to absorbance Aa, Am being absorbance at the maximum absorbing wavelength ($\lambda max_1$) when 30 mol of a dye fixing agent being added to 1 mol of a thermally transferable dye, Aa being absorbance at the maximum absorbing wavelength ($\lambda max_1$) when 3 mol of a dye fixing agent being added to 1 mol of a thermally transferable dye, as defined by foregoing Formula (1), and the formula value is preferably more than 90, but is more preferably 90–100.

Absorbance Am and Aa of a thermally transferable dye, defined in this invention is determined by using a commercial spectrophotometer, after the thermally transferable dye is dissolved in an appropriate solvent.

An example of the determining methods is explained below.

Taken is a 1 mg sample of thermally transferable dye, the absorbance of which is to be determined, and to this, added is a dye fixing agent such as a metal ion containing compound in an amount of 30 times mol of the thermally transferable dye, after which acetone is further added, to dissolve them and to bring the total volume to 100 ml. Using a spectrophotometer such as Spectrophotometer 330, Spectrometer U-3210, Spectrophotometer U-3410, or Spectrophotometer U-4000, all of which are manufactured by Hitachi, Ltd., and Spectrophotometer CM-2022, manufactured by Minolta Co., Ltd., the absorbing spectrum of the solution is determined. Then, absorbance of Am at a wavelength of an absorption maximum ($\lambda max_1$) is determined. In the same manner, except that a dye fixing agent is added in the amount of 3 times mol of the thermally transferable dye, Aa of absorbance at $\lambda max_1$ is determined to finally obtain Aa/Am×100.

By employing a thermally transferable dye which is highly reactive with a dye fixing agent, which dye exhibits Aa/Am×100 defined in this invention of more than 75, images having superiority in light stability, background whiteness and film layer adhesiveness can thereby be obtained.

Further, in the thermal transfer recording material of this invention, the thermally transferable dyes are at least three kinds of dyes of a yellow dye, a magenta dye and a cyan dye, and it is preferable that the cyan dye is reactive with a dye fixing agent and is a thermally transferable dye satisfying the relationship defined by foregoing Formula (1); or that the magenta dye and the cyan dye are reactive with a dye fixing agent and are thermally transferable dyes satisfying the relationship defined by foregoing Formula (1); or all of the cyan dye, the magenta dye and the yellow dye are reactive with a dye fixing agent and are thermally transferable dyes satisfying the relationship defined by foregoing Formula (1).

Further, in the image forming method of this invention, images are formed using a yellow ink layer containing a yellow-dye, a magenta ink layer containing a magenta dye and a cyan ink layer containing a cyan dye, and further it is preferable that images are printed in the order of the value of Aa/Am×100 defined by Formula (1), starting with the ink layer which contains the thermally transferable dye having the smallest value. The images which are printed in the ascending order of values, can obtain enhanced image storage stability (being specifically light stability).

The thermally transferable dye of this invention will now be described.

The thermally transferable dyes used in the ink layer of this invention include every traditionally well-known dye which is employed in a thermal transfer sheet of a thermal sublimation transfer system, such as an an azomethine type, methane type, an anthlaquinone type, a quinophthalone type, or a naphthoquinone type dye, and are specifically not limited, as long as they satisfy the requirements of this invention. Specifically, listed are, as yellow dyes: Foron Brilliant Yellow S-6GL, PTY-52, and Macrolex Yellow 6G; as red dyes: MS Red G, Macrolex Red Violet R, Celes Red 7B, Samaron Red HBSL, and SK Rubin SEGL; and as blue dyes: Kayaset Blue 714, Waxoline Blue AP-FW, Foron Brilliant Blue S-R, MS Blue 100, and Daito Blue No. 1.

Further, as thermally transferable dyes capable of forming chelates, there is specifically no limitation as long as they satisfy the requirements defined in this invention, and employed can be various well-known compounds, for example, cyan dyes, magenta dyes and yellow dyes described in JP-A Nos. 59-78893, 59-109349, 4-94974, and 4-97894, and Japanese Patent Publication (hereinafter, referred to as JP-B) No. 285622.

Examples of thermally transferable dyes usable in this invention will be described below, but the present invention is not limited to these.

For example, as chelate cyan dyes, listed are compounds represented by the following Formula (I).

Formula (I)

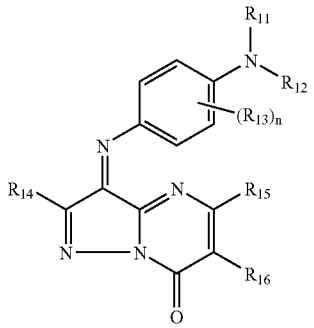

In Formula (I), $R_{11}$ and $R_{12}$ are each a substituted or unsubstituted aliphatic group, which may be the same or different. As aliphatic groups, listed are an alkyl group, cycloalkyl group, alkenyl group, and an alkynyl group. Alkyl groups include, for example, a methyl group, ethyl group, propyl group, i-propyl group, and substituted groups of the alkyl groups include a straight chain or a branched alkyl groups (such as a methyl group, ethyl group, i-propyl group, t-butyl group, n-dodecyl group, or a 1-hexylnonyl group), a cycloalkyl group (such as a cyclopropyl group, cyclohexyl group, bicyclo[2.2.1]heptyl group, or an adamantyl group), and an alkenyl group (such as 2-propylene group, or an oleyl group), an aryl group (such as a phenyl group, ortho-tolyl group, ortho-anisyl group, 1-naphthyl group, or a 9-anthranyl group), a heterocyclic group (such as 2-tetrahydrofuryl group, 2-thiophenyl group, 4-imidazolyl group, or a 2-pyridyl group), an halogen atom (such as a fluorine atom, a chlorine atom, or a bromine atom), a cyano group, a nitro group, a hydroxyl group, a carbonyl group (such as an alkylcarbonyl group, e.g., an acetyl group, trifluoroacetyl group, or a pivaloyl group; or an arylcarbonyl group, e.g., a benzoyl group, a pentafluorobenzoyl group, or a 3,5-di-t-butyl-4-hydroxybenzoyl group), an oxycarbonyl group (such as an alkoxycarbonyl group e.g., a methoxycarbonyl group, a cyclohexyloxycarbonyl group, or an n-dodecyloxycarbonyl group; an aryloxycarbonyl group e.g., a phenoxycarbonyl group, a 2,4-di-t-amilphenoxycarbonyl group, a 1-naphthyloxycarbonyl group; or a heterocyclic oxycarbonyl group e.g., a 2-pyridyloxycarbonyl group, or a 1-phenylpyrazolyl-5-oxycarbonyl group), a carbamoyl group (such as an alkylcarbamoyl group e.g., a dimethylcarbamoyl group, or a 4-(2,4-di-t-amilphenoxy) butylaminocarbamoyl group; an arylcarbamoyl group e.g., a phenylcarbamoyl group, or a 1-naphthylcarbamoyl group), an alkoxyl group (such as a methoxy group, or a 2-ethoxyethoxy group), an aryloxy group (such as a phenoxy group, a 2,4-di-t-amilphenoxy group, or a 4-(4-hydroxyphenylsulfonyl)phenoxy group), a heterocyclic oxy group (such as a 4-pyridyloxy group, or a 2-hexahydropyranyloxy group), a carbonyloxy group (such as an alkylcarbonyloxy group e.g., an acetyloxy group, a trifluoroacetyloxy group, or a pybaroyloxy group; or an arylcarbonyloxy group e.g., a benzoylcarbonyloxy group, or a pentafluorobenzoylcarbonyloxy group), a urethane group [such as an alkylurethane group e.g., N,N-dimethylurethane group; or an arylurethane group e.g., an N-phenylurethane group or an N-(p-cyanophenyl) urethane group], a sulfonyloxy group (such as an alkylsulfonyloxy group e.g., a methanesulfonyloxy group, trifluoromethanesulfonyloxy group, or an n-dodecansulfonyloxy group; or an arylsulfonyloxy group e.g., a benzenesulfonyloxy group or a p-toluenesulfonyloxy group), an amino group (such as an alkylamino group e.g., a dimethylamino group, cyclohexylamino group, or an n-dodecylamino group; or an arylamino group e.g., an anilino group or a p-t-octylanilino group), a sulfonylamino group (such as an alkylsulfonylamino group e.g., a methanesulfonylamino group, a heptafluoropropanesulfonylamino group, or an n-hexadecylsulfonylamino group; or an arylsulfonylamino group e.g., a p-toluenesulfonylamino group, or a pentafluorobenzenesulfonylamino group), a sulfamoylamino group (such as an alkylsulfamoylamino group e.g., an N,N-dimethylsulfamoylamino group; an arylsulfamoylamino group e.g., an N-phenylsulfamoylamino group), an acylamino group (such as an alkylcarbonylamino group e.g., an acetylamino group or a myristoylamino group; or an arylcarbonylamino group e.g., a benzoylamino group), a ureide group [such as an alkylureide group e.g., an N,N-dimethylaminoureide group; an arylureide group e.g., an N-phenylureide group, or an N-(p-cyanophenyl)ureide group], a sulfonyl group (such as an alkylsulfonyl group e.g., a methanesulfonyl group or a trifluoromethanesulfonyl group; an arylsulfonyl group e.g., p-toluenesulfonyl group), a sulfamoyl group [such as an alkylsulfamoyl group e.g., a dimethylsulfamoyl group, or a 4-(2,4-di-t-amilphenoxy)butylaminosulfamoyl group; or an arylsulfamoyl group e.g., a phenylsulfamoyl group], an alkylthio group (such as a methylthio group or a t-octylthio group), an arylthio group (such as a phenylthio group), and a heterocyclicthio group (such as a 1-phenyltetrazole-5-thio group, or a 5-methyl-1,3,4-oxadiazole-2-thio group).

Examples of cycloalkyl groups and alkenyl groups are the same as the foregoing substituent groups. Further, examples of alkynyl groups include a 1-propyne, 2-butine and a 1-hexyne.

As $R_{11}$ and $R_{12}$, preferred are also groups which form a non-aromatic ring structure (such as a pyrrolidine ring, a pyperidine ring and a morpholine ring).

Of the foregoing substituent groups, $R_{13}$ is to be preferably to be an alkyl group, cycloalkyl group, alkoxy group or an acylamino group, while "n" is an integer of 0–4, and when "n" is two or more, a plurality of $R_{13}$ may be the same or different.

$R_{14}$ is an alkyl group, examples of which include a methyl group, ethyl group, i-propyl group, t-butyl group, n-dodecyl group and a 1-hexylnonyl group. $R_{14}$ is preferably a secondary or tertiary alkyl group, and examples of which are preferably secondary or tertiary alkyl groups including an isopropyl group, sec-butyl group, tert-butyl group, and 3-heptyl group. The most preferable subsituent groups as $R_{14}$ include an isopropyl group and a tert-butyl group. The alkyl group of $R_{14}$ may be substituted, and in this case, substituted with a substituent group consisting exclusively of carbon atoms and hydrogen atoms.

$R_{15}$ is an alkyl group, examples of which include an n-propyl group, i-propyl group, t-butyl group, n-dodecyl group, 1-hexylnonyl group. $R_{15}$ is preferably a secondary or tertiary alkyl group, and examples of the preferable secondary or tertiary alkyl group include an isopropyl group, sec-butyl group, tert-butyl group, and 3-heptyl group. The most preferable substituent groups as $R_{15}$ are an isopropyl group and tert-butyl group. The alkyl group of $R_{15}$ may be substituted, and in this case, with a substituent group consisting exclusively of carbon atoms and hydrogen atoms.

$R_{16}$ is an alkyl group, examples of which include an n-propyl group, n-butyl group, n-pentyl group, n-hexyl group, n-heptyl group, isopropyl group, sec-butyl group, tert-butyl group, and a 3-heptyl group. Specifically preferable substituent groups as $R_{16}$ are a straight chain alkyl group of more than three carbon atoms, examples of which include an n-propyl group, n-butyl group, n-pentyl group, n-hexyl group, and an n-heptyl group, and most preferable are an n-propyl group and an n-heptyl group. The alkyl group of $R_{16}$ may be substituted, and in this case, with a substituent group consisting exclusively of carbon atoms and hydrogen atoms.

Specific examples of dyes containing chelate cyan dyes represented by foregoing Formula (I), which are employable in this invention, are shown below, but the present invention is not limited to them.

C-1

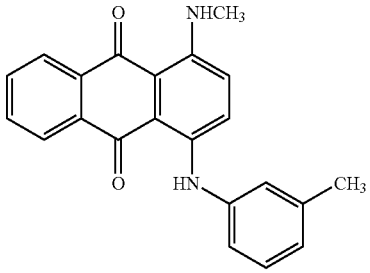

C-2

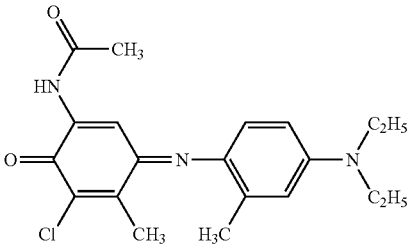

C-3

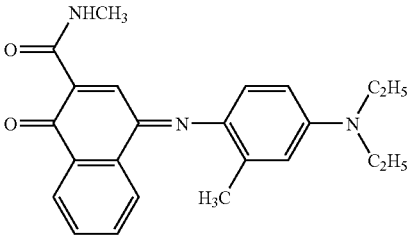

C-4

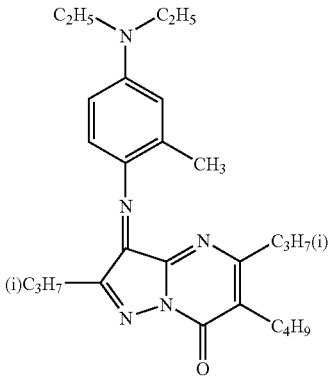

-continued

C-5

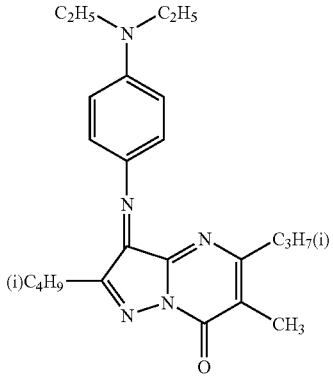

C-6

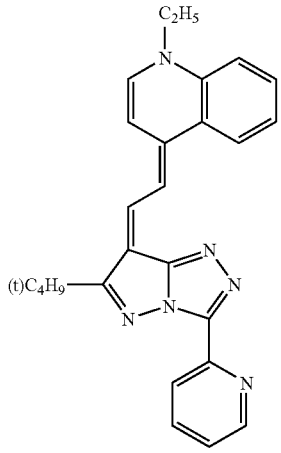

C-7

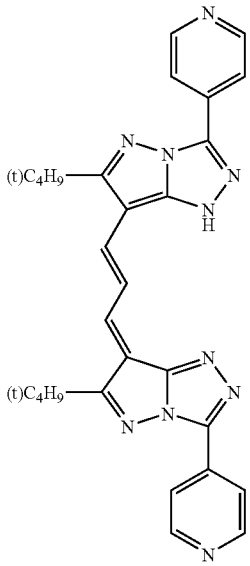

-continued

C-8

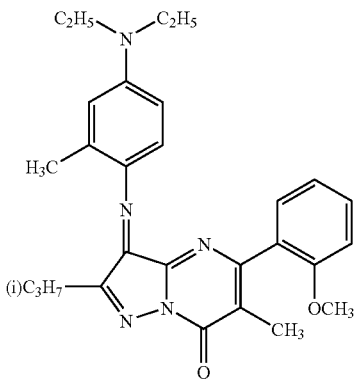

C-9

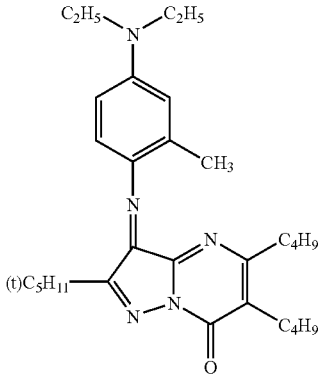

C-10

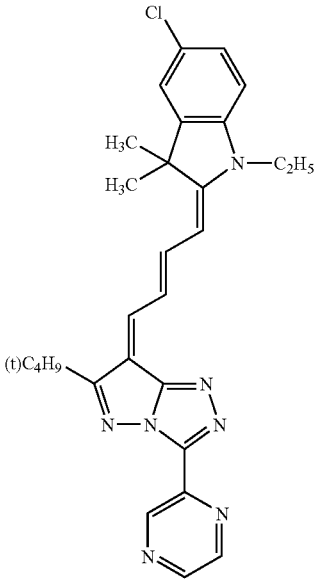

-continued

C-11

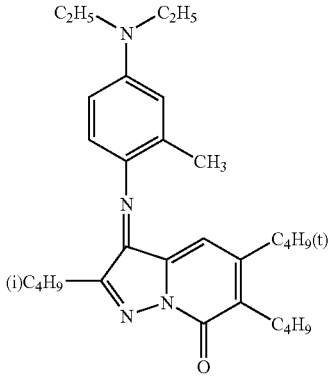

Further, as examples of chelate yellow dyes, listed are compounds represented by following Formula (II).

Formula (II)

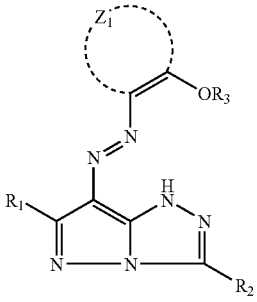

In foregoing Formula (II), substituent groups represented by $R_1$ and $R_2$ are each, for example, a halogen atom, an alkyl group (being an alkyl group of 1–12 carbon atoms which may be substituted with a substituent group combined with an oxygen atom, nitrogen atom, sulfur atom or a carbonyl group; or may be substituted with an aryl group, alkenyl group, alkynyl group, hydroxyl group, amino group, nitro group, carboxyl group, cyano group or a halogen atom, and including a group of methyl, isopropyl, t-butyl, trifluoromethyl, methoxymethyl, 2-methanesulfonylethyl, 2-methanesulfoneamideethyl, and cyclohexyl), an aryl group (such as a group of phenyl, 4-t-butylphenyl, 3-nitrophenyl, 3-acylaminophenyl, and 2-methoxyphenyl), a cyano group, an alkoxyl group, an aryloxy group, an acylamino group, an anilino group, a ureide group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, a heterocyclic oxy group, an acyloxy group, a carbamoyloxy group, a silyloxy group, an aryloxycarbonylamino group, an imide group, a heterocyclic thio group, a phosphonyl group, and an acyl group.

The alkyl group or aryl group represented by $R_3$ include the same groups as the alkyl group and the aryl group represented by $R_1$ and $R_2$.

$Z_1$ is a group of atoms to form a 5- or 6-membered aromatic rings together with the two carbon atoms, specifically listed are rings of benzene, pyridine, pyrimidine, triazine, pyrazine, pyridazine, pyrrole, furan, thiophene, pyrazole, imidazole, triazole, oxazole and thiazole. These rings may further form a condensed ring with other rings. In addition, these rings may be substituted with other substituent groups, examples of which include the same ones represented by $R_1$ and $R_2$.

Specific examples of dyes containing chelate yellow dyes represented by foregoing Formula (II), which are employable in this invention, are shown below, but the present invention is not limited to them.

Y-1

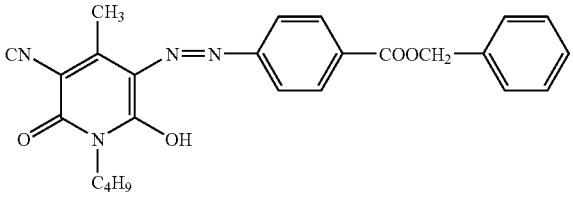

Y-2

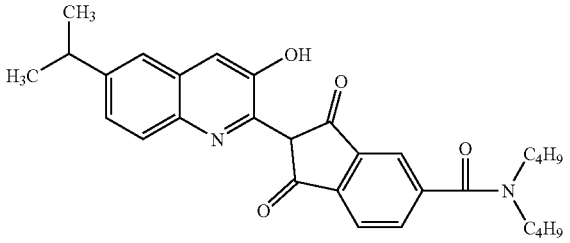

Y-3

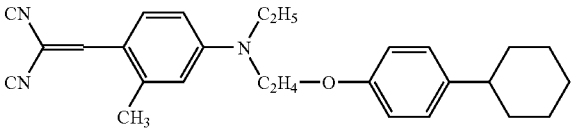

Y-4

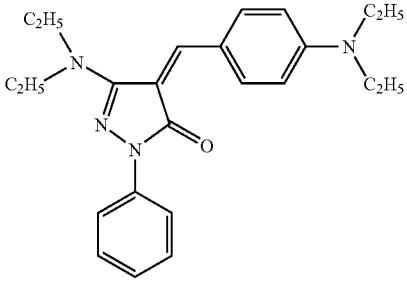

-continued

Y-5

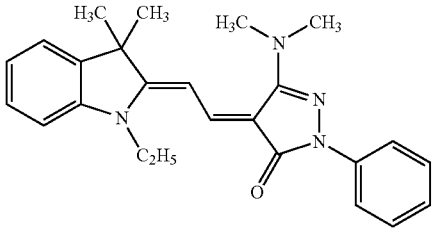

Y-6

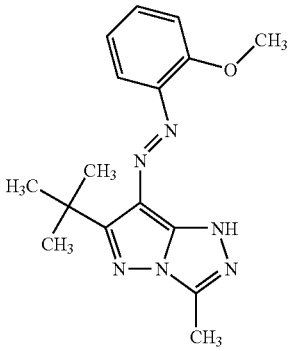

Y-7

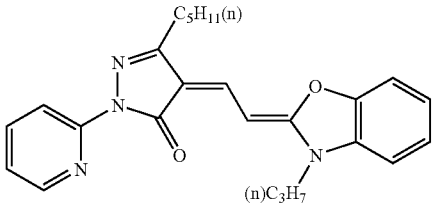

For example, as chelate magenta dyes, listed are compounds represented by following Formula (III).

Formula (III)

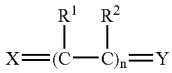

In above Formula (III), X is a group or an aggregation of atoms which is capable of forming a bidentate chelate, Y is an aggregation of atoms capable of forming a 5- or 6-membered, aromatic hydrocarbon ring or heterocyclic ring, $R_1$ and $R_2$ are each a hydrogen atom, a halogen atom or a mono-valent substituent group, and "n" is 0, 1 or 2.

As "X", specifically preferably is a group represented by following Formula (IV).

Formula (IV)

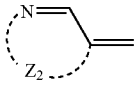

In above Formula (IV), $Z_2$ is an aggregation of atoms which are necessary to form an aromatic nitrogen containing heterocyclic ring, substituted by a nitrogen containing a chelatable group. Specific examples of these rings include a pyridine, pyrimidine, thiazole, and an imidazole ring. These rings may form a condensed ring with other carbocyclic group (such as a benzene ring) or a heterocyclic ring (such as a pyridine ring).

In above Formula (III), Y is an aggregation of atoms forming a 5- or 6-membered, aromatic hydrocarbon ring or heterocyclic ring, on which there may be a further substituent group or a condensed ring. Specific examples of these rings include a 3H-pyrrol ring, an oxazole ring, an imidazole ring, a thiazole ring, a 3H-indole ring, a benzoxazole ring, a benzimidazole ring, a benzothiazole ring, a quinoline ring, and a pyridine ring. These rings may form a condensed ring with other carbocyclic group (such as a benzene ring) or a heterocyclic ring (such as a pyridine ring). Substituent groups on the rings include an alkyl group, an aryl group, a heterocyclic group, an acyl group, an amino group, a nitro group, a cyano group, an acylamino group, an alkoxy group, a hydroxyl group, an alkoxycarbonyl group and a halogen atom, and these groups may further be substituted.

$R^1$ and $R^2$ are each a hydrogen atom, a halogen atom (such as a fluorine atom or a chlorine atom) or a mono-valent substituent group, and as mono-valent substituent groups, listed are an alkyl group, an alkoxy group, a cyano group, an alkoxycarbonyl group, an aryl group, a heterocyclic group, a carbamoyl group, a hydroxyl group, an acyl group and an acylamino group.

X is a group or an aggregation of atoms which is capable of forming at least a bidentate chelate, and employed may be any of these which form a dye of Formula (III), and, for example, preferable is 5-pyrazolone, imidazole, pyrazolopyrrol, prazolopyrazole, pyrazoloimidazole, pyrazolotriazol, pyrazolotetrazole, barbituric acid, thiobarbituric acid, rhodanine, hydantoin, oxazolone, isooxazolone, indandione, pyrazolidinedione, oxazolidinedione, hydroxypyridone, or pyrazolopyridone.

Specific examples of dyes containing chelate magenta dyes represented by foregoing Formula (III), which are employable in this invention, are shown below, but the present invention is not limited to them.

M-1

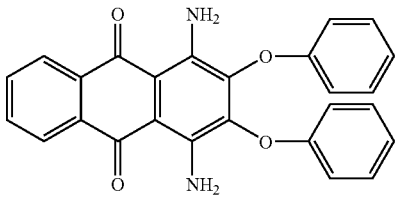

M-2

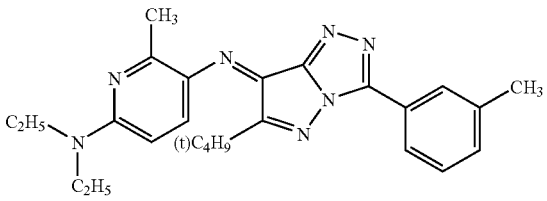

-continued

M-3

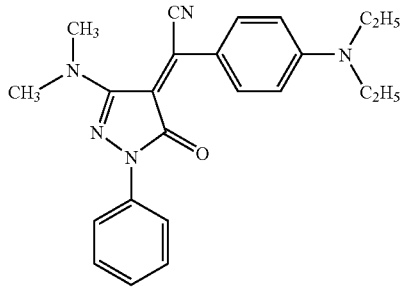

M-4

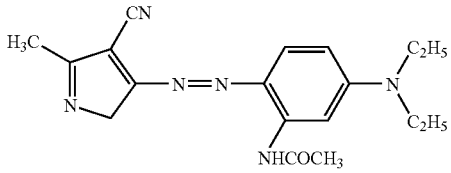

M-5

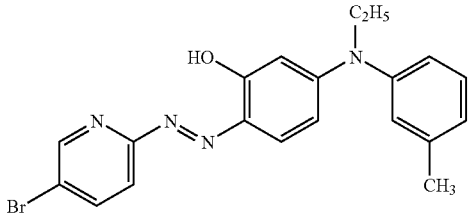

M-6

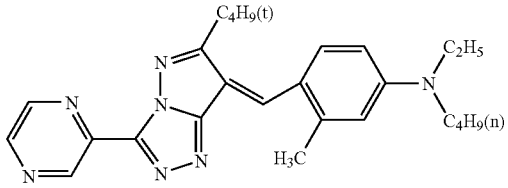

M-7

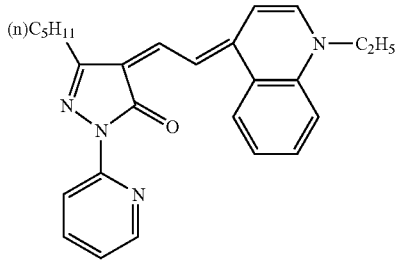

M-8

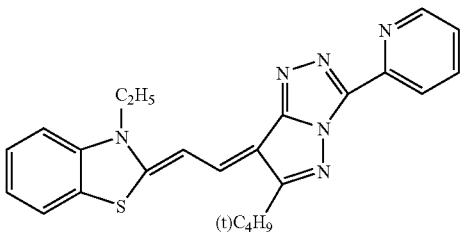

Regarding each dye exemplified above, presence or absence of reactivity with a dye fixing agent and the value of Aa/Am×100 determined with the foregoing method are shown in Table 1.

TABLE 1

| Thermally transferable dye No. | Presence or absence of reactivity with dye fixing agent | Aa/Am × 100 |
|---|---|---|
| Exemplified compound C-1 | Absence | — |
| Exemplified compound C-2 | Absence | — |
| Exemplified compound C-3 | Absence | — |
| Exemplified compound C-4 | Presence | 73 |
| Exemplified compound C-5 | Presence | 93 |
| Exemplified compound C-6 | Presence | 100 |
| Exemplified compound C-7 | Presence | 74 |
| Exemplified compound C-8 | Presence | 68 |
| Exemplified compound C-9 | Presence | 86 |
| Exemplified compound C-10 | Presence | 97 |
| Exemplified compound C-11 | Presence | 93 |
| Exemplified compound M-1 | Absence | — |
| Exemplified compound M-2 | Absence | — |
| Exemplified compound M-3 | Absence | — |
| Exemplified compound M-4 | Absence | — |
| Exemplified compound M-5 | Presence | 100 |
| Exemplified compound M-6 | Presence | 99 |
| Exemplified compound M-7 | Presence | 97 |
| Exemplified compound M-8 | Presence | 100 |
| Exemplified compound Y-1 | Absence | — |
| Exemplified compound Y-2 | Absence | — |
| Exemplified compound Y-3 | Absence | — |
| Exemplified compound Y-4 | Absence | — |
| Exemplified compound Y-5 | Absence | — |
| Exemplified compound Y-6 | Presence | 100 |
| Exemplified compound Y-7 | Presence | 99 |

Next, the details of the image forming method and the thermal transfer recording material of this invention will be described.

In the image forming method of this invention, an image receiving sheet for thermal transfer recording (hereinafter, referred to also as an image receiving sheet) and an thermal transfer recording material (hereinafter, referred to also as a thermal transfer sheet or an ink sheet) of this invention are superimposed, after which both of them are heated based on recording signals, and after images are formed on the thermally transferable dye receiving layer, a transferable protective layer prepared on the thermal transfer sheet is thermally transferred onto the formed images, resulting in formation of a protective layer on the images. In the above description, the image receiving sheet has a thermally transferable dye receiving layer on a substrate, and the thermal transfer sheet or the ink sheet has an ink layer which contains a thermally transferable dye capable of forming a chelate complex with a metal ion containing compound.

Firstly, the thermal transfer recording material will be described.

Thermal Transfer Recording Material

The thermal transfer recording material of this invention (hereinafter, referred to also as a thermal transfer sheet or an ink sheet) has an ink layer which contains thermally transferable dyes.

In the thermal transfer sheet of this invention, an ink layer of each color is respectively and sequentially provided on the same side of the substrate. Further, a transferable protective layer may be provided on the same substrate as each ink layer being provided, or a different substrate from the ink layers being provided. However, in this invention, the transferable protective layer is preferably provided on the same substrate, sequentially on the same side of the substrate, as the ink layers being provided, from the viewpoint of image printing efficiency.

FIG. 1 is a perspective view showing an instance of a thermal transfer recording material of this invention, providing ink layers and a transferable protective layer sequentially on the same side of a substrate.

In FIG. 1, thermal transfer sheet 11 has ink layers 13Y, 13M and 13C corresponding to separate yellow (Y), magenta (M) and cyan (C) dyes on the same plane of substrate 12, and on regions other than the ink layers, transferable image protective layer unit 14 (in FIG. 1, shown as a three layer configuration) having a peelable, transferable protective layer is sequentially provided on the same side. Further, on the other side of the substrate., backing layer 15 (being a heat resistant slipping layer) is provided.

In FIG. 1, there are slight gaps between adjacent ink layers or transferable image protective layer unit, and the gaps may optionally be adjusted with a controlling method suitable to the thermal transfer recording apparatus. Further, in order to improve the cue up accuracy of each ink layer, a detector mark is preferably provided on the thermal transfer sheet, of which the methods are not specifically limited. Here, the examples which have ink layers and a transferable image protective layer unit, or ink layers and a region for post heating treatment, on the same side of a substrate are described. However, it is obvious that each layer can be provided onto different layers respectively. In cases when reactive dyes are employed in respective ink layers, strictly speaking, dyes contained in the ink layers are unreacted yet compounds, and not yet Y, M or C dyes. However, in the sense that these are the compounds which will form final Y, M and C images, similar expressions are expediently used.

Substrate

As substrates employed for a thermal transfer sheet of this invention, listed are the materials well-known for conventional substrates of a thermal transfer sheet. Specific examples of preferable substrates include ultra thin paper such as glassine, condenser paper, paraffin paper; high heat resistant polyester sheets made of such as polyethylene terephthalate, polyethylene naphthalate, polybutylene terephthalate, polyphenylene sulfide, polyether ketone, and polyether sulfone; drawn or undrawn plastic films such as polypropylene, fluorocarbon resin, polycarbonate, cellulose acetate, polyethylene derivatives, polyvinyl chloride, polyvinylidene chloride, polystyrene, polyamide, polyimide, polymethylpenten, or ionomers, or laminated plastics of these materials. The thickness of the substrate is appropriately selected to obtain desirable strength and heat resistance based on these materials, generally however, they are preferably employed in the about 1–100 μm range.

Further, regarding adhesion of the substrate with an ink layer formed on the surface of the substrate, it is preferable that the surface is subjected to primer treatment or corona discharge treatment.

Ink Layer

The ink layers composing the thermal transfer sheet of this invention is a thermally sublimating coloring agent layer containing at least the foregoing thermally transferable dye as well as a binder resin.

Employed as binders used in the ink layer are those which are employed in thermal transfer sheets for conventional heat-sensitive sublimation transfer system. Listed as those binders may, for example, be a cellulose based resin such as cellulose addition compound, cellulose ester, and cellulose ether; a polyvinyl acetal resin such as polyvinyl alcohol, polyvinyl formal, polyvinyl acetoacetal, or polyvinyl butyral; a vinyl based resin such as polyvinyl pyrrolidone, polyvinyl acetate, polyacrylamide, styrene resin, poly (metha)acrylic acid based ester, or poly(metha)acrylic acid copolymer; a rubber based resin, an ionomer resin, an olefin resin, and a polyester resin. Of these resins, preferred are polyvinyl butyral, polyvinyl acetoacetal, or a cellulose based resin.

Further, as binder resins of the ink layer, listed are reaction products of isocyanates and compounds having an active hydrogen selected from polyvinyl butyral, polyvinyl formal, polyester polyol and acryl polyol, above reaction products but isocyanates being diisocyanates or triisocyanates, and above reaction products but isocyanates being 10–200 weight parts to 100 weight parts of compounds having an active hydrogen, as described in JP-B 5-78437; organic solvent soluble polymers derived from natural and/or semisynthetic water-soluble polymers which intermolecular hydroxyl group is esterified and/or urethanated, and natural and/or semisynthetic water-soluble polymers; cellulose acetate having a degree of acetylation of more than 2.4 and a total degree of substitution of more than 2.7, described in JP-A 3-264393; vinyl based resins such as polyvinyl alcohol (being Tg of 85° C.), polyvinyl acetate (being Tg of 32° C.), and vinyl chloride/vinyl acetate copolymer (being Tg of 77° C.), polyvinyl acetal based resins such as polyvinyl butyral (being Tg of 84° C.) and polyvinyl acetoacetal (being Tg of 110° C.), vinyl based resins such as polyacrylamide (being Tg of 77° C.), and polyester resins such as aliphatic polyester (being Tg of 130° C.); reaction products of isocyanates and polyvinyl butyral, in which weight of contained vinyl alcohol portion is 15–44%, and above reaction products but above isocyanates being diisocyanates or triisocyanates, described in JP-A 7-52564; phenylisocyanate modified polyvinyl acetal resins represented by formula (1), described in JP-A 7-32742; hardened materials of compositions containing one of isocyanate-reactive phenoxy resins or isocyanate-reactive acetal resins, one resin selected from isocyanate-reactive vinyl resins, isocyanate-reactive acryl resins, isocyanate-reactive phenoxy resins and isocyanate-reactive styrol resins, and polyisocyanate compounds, described in JP-A 6-155935; polyvinyl butyral resins (preferably having a molecular weight of more than 60,000 and Tg of more than 60° C., more preferably having Tg of 70–110° C., a weight of a vinyl alcohol portion in polyvinyl butyral resin being 10–40%, preferably 15–30%); and cellulose based resins such as ethyl cellulose, hydroxyethyl cellulose, ethylhydroxy cellulose, hydroxypropyl cellulose, methyl cellulose, cellulose acetate, and cellulose butyrate acetate (being preferably ethyl cellulose).

The foregoing various binder resins may be employed alone or in combination more than two kinds.

Further, if desired, incorporated in the ink layer of this invention may be various prior art additives other than the dyes and binder resins described above. It is possible to form an ink layer in such a manner that a liquid ink coating composition, prepared by dissolving or dispersing the above dyes and binder resins, and other additives in suitable solvents, is applied onto a substrate employing a prior art means, such as a gravure coating method, and subsequently dried. It is possible to set the thickness of the ink layer of this invention commonly at about 0.1–about 3.0 μm and preferably at 0.3–1.5 μm.

Transferable Protective Layer

In the thermal transfer sheet of this invention, it is preferable that a thermally transferable protective layer is provided on the same side as the foregoing ink layer. The above thermally transferable protective layer comprises a transparent resinous layer which is converted to a protective layer covering, via thermal transfer, the surface of images which are formed on an image receptive layer.

Exemplified as resins forming a protective layer may be polyester resins, polystyrene resins, acryl resins, polyurethane resins, acryl urethane resins, polycarbonate resins, epoxy-modified resins of each of these resins, silicone-modified resins of each of these resins, and mixtures thereof, as well as ionizing radiation curing resins and ultraviolet ray blocking resins. Listed as preferred resins are polyester resins, polycarbonate resins, epoxy-modified resins, and ionizing radiation curing resins. Preferred as polyester resins are alicyclic polyester resins comprised of alicyclic compounds comprising at least a diol component and an acid component. Preferred as polycarbonate resins are aromatic polycarbonate resins. Of these, aromatic polycarbonate resins described in JP-A 11-151867 are particularly preferred.

Listed as epoxy-modified resins employed in this invention are epoxy-modified urethane, epoxy-modified polyethylene, epoxy-modified polyethylene terephthalate, epoxy-modified polyphenyl sulfite, epoxy-modified cellulose, epoxy-modified polypropylene, epoxy-modified polyvinyl chloride, epoxy-modified polycarbonate, epoxy-modified acryl, epoxy-modified polystyrene, epoxy-modified polymethyl methacrylate, epoxy-modified silicone, copolymers of epoxy-modified polystyrene and epoxy-modified polymethyl methacrylate, copolymers of epoxy-modified acryl and-epoxy-modified polystyrene, as well as copolymers of epoxy-modified acryl and epoxy-modified silicone. Of these, preferred are epoxy-modified acryl, epoxy-modified polystyrene, epoxy-modified polymethyl methacrylate, and epoxy-modified silicone, but more preferred are copolymers of epoxy-modified polystyrene and epoxy-modified polymethyl methacrylate, copolymers of epoxy-modified acryl and epoxy-modified polystyrene, and copolymers of epoxy-modified acryl and epoxy-modified silicone.

Ionizing Radiation Curing Resins

It is possible to use ionizing radiation curing resins as a thermal transferable protective layer. Their incorporation in the thermal transferable protective layer results in excellent plasticizer resistance and abrasion resistance. Employed as ionizing radiation curing resins may be any of those known in the art. For example, if desired employed may be those prepared in such a manner that radically polymerizable polymers or oligomers are subjected to crosslinking and curing by exposure to ionizing radiation and if desired, are subjected to polymerization crosslinking employing electron beams and ultraviolet radiation in the presence of photopolymerization initiators.

Ultraviolet Ray Blocking Resins

The main purpose of the protective layer containing ultraviolet ray blocking resins is to provide light stability to printed matter. As ultraviolet ray blocking resins, it is possible to use, for example, resins which are prepared in such a manner that reactive ultraviolet absorbing agents are allowed to react with, and bond to, thermoplastic resins or the above ionizing radiation curing resins. More specifically, it is possible to list those which are prepared by introducing a reactive group such as ones having an addition-polymerizable double bond (such as a vinyl group, an acryloyl group, and a metha-acryloyl group) or an alcoholic hydroxyl group, an amino group, a carboxyl group, an epoxy group, or isocyanate group into an unreactive organic ultraviolet absorbing agents such as salicylate based, benzophenone based, benzotriazole based, substituted acrylonitrile based, nickel chelate based, hindered amine based ones which are conventionally known in the art.

The main protective layer arranged in the thermally transferable protective layer, in a single layer or multilayer structure, as described above, is formed to result in a thickness of commonly about 0.5–about 10 μm, even though it may vary depending on the types of protective layer forming resins.

It is preferable that the thermally transferable protective layer of this invention is provided on a substrate sheet via a non-transferable releasing layer.

For the purpose such that the non-transferable releasing layer achieves an adhesion force between the substrate sheet and the non-transferable releasing layer which is higher than the adhesion force between the non-transferable releasing layer and the thermally transferable protective lawyer, and also achieves a higher adhesion force between the non-transferable releasing layer and the thermally transferable protective layer after applying heat than that prior to applying heat, it is preferable that (1) inorganic micro-particles of an average diameter of at most 40 nm are incorporated in an amount of 30–80 weight % together with resinous binders; (2) alkyl vinyl ether-maleic anhydride copolymers, derivatives thereof or mixtures thereof are incorporated in a total amount of at least 20 weight %; or (3) ionomers are incorporated in an amount of at least 20 weight %. If desired, other additives may be incorporated in the non-transferable releasing layer.

Employed as inorganic micro-particles may, for example, be silica micro-particles such as anhydrous silica and colloidal silica, as well as particles of metal oxides such as tin oxide, zinc oxide, or zinc antimonate. It is preferable that the diameter of the inorganic micro-particles is controlled to be at most 40 nm. When the diameter exceeds 40 nm, surface unevenness of the thermally transferable protective layer increases due to the surface unevenness of the releasing layer. As a result, the transparency of the protective layer is unacceptably degraded.

Resinous binders which are blended with inorganic micro-particles are not particularly limited, and it is possible to use any resins which are mixable. Examples include polyvinyl alcohol resins (PVA) of various degrees of saponification, polyvinyl acetal resins, polyvinyl butyral resins; acryl based resins; polyamide based resins; cellulose based resins such as cellulose acetate, alkylcellulose, carboxymethylcellulose, and hydroxyalkylcellulose resins; as well as polyvinylpyrrolidone resins.

It is preferable that the blending ratio of the inorganic micro-particles to the other blending components comprising resinous binders as a main component, (inorganic micro-particles/other blending components), is controlled to be in the range of 30/70–80/20 as a weight ratio. When the blending ratio is less than 30/70, desired effects of the inorganic micro-particles become insufficient. On the other hand, when the ratio exceeds 80/20, the resultant releasing layer results in an incomplete layer, whereby portions are formed wherein the substrate sheet and the protective layer are brought into direct contact.

Employed as alkyl vinyl ether-maleic anhydride copolymers, or derivatives thereof may, for example, be those in which an alkyl group in the alkyl vinyl ether portion is either a methyl group or an ethyl group, and in which the maleic anhydride portion results in a half ester, partially or completely, with alcohol (e.g., methanol, ethanol, propanol, isopropanol, butanol, and isobutanol).

The releasing layer may be formed by employing only alkyl vinyl ether-maleic anhydride copolymers, derivatives thereof or mixtures thereof. For the purpose of controlling the delamination strength between the releasing layer and the protective layer, other resins or micro-particles may be further added. In such a case, it is preferable that in the releasing layer, alkyl vinyl ether-maleic anhydride copolymers and derivatives thereof, as well as mixtures thereof may be incorporated in an amount of at least 20 weight %. When the content is less than 20 weight %, it is not possible to result in sufficient desired effects of the alkyl vinyl ether-maleic anhydride copolymers and derivatives thereof.

Resins or micro-particles which are blended with the alkyl vinyl ether-maleic anhydride copolymers or derivatives thereof are not particularly limited, and any of them may be employed as long as they are mixable and result in desired layer transparency during layer formation. For example, preferably employed are the foregoing inorganic micro-particles, and resinous binders which are mixable with inorganic micro-particles.

Employed as ionomers may, for example, be Surlyn A (manufactured by E.I. du Pont de Namous and Co.) and the Chemipearl Series (manufactured by Mitusi Petrochemical Industries, Ltd.). Further, added to ionomers are, for example, the foregoing inorganic micro-particles, resinous binders mixable with inorganic micro-particles, or other resins and micro-particles.

The non-transferable releasing layer is formed in such a manner that a liquid coating composition containing any of the foregoing components (1)–(3) at the specified blending ratio is prepared; the resultant liquid coating composition is applied onto a substrate employing a prior art technique such as a gravure coating method or a gravure reverse coating method; and the resultant coating is dried. The thickness of the non-transferable releasing layer after drying is commonly set at about 0.1–about 2 μm.

A thermally transferable protective layer applied onto a substrate, via or not via the non-transferable releasing layer, may be in a multilayer or a single layer structure. In the case of the multilayer structure, other than the main protective layer which provides various types of durability to images, provided may be an adhesion layer arranged on the outermost surface of the thermally transferable protective layer to enhance adhesion between the thermally transferable protective layer and the image surface of printed matter, an auxiliary protective layer, and a layer (for example, an anti-counterfeiting layer and a hologram layer) which is used to add functions other than original one of the protective layer. The sequence of the main protective layer and other layers are somewhat optional. However, other layers are commonly arranged between the adhesion layer and the main protective layer so that, after the transfer, the main protective layer becomes the outermost surface of the image receiving surface.

An adhesion layer may be formed on the outermost surface of the thermally transferable protective layer. It is possible to form the adhesion layer employing resins such as acryl resins, vinyl chloride based resins, vinyl acetate based resins, vinyl chloride/vinyl acetate copolymer resins, polyester resins, or polyamide resins, which exhibit desired adhesion during an adhesion under heating. Further in addition to the above resins, if desired, ionizing radiation curing resins and ultraviolet ray blocking resins, described above, may be blended. The thickness of the adhesion layer is commonly set at 0.5–5 μm.

The thermally transferable protective layer is formed on a non-transferable releasing layer or a substrate in such a manner that, for example, a liquid protective layer coating composition containing protective layer forming resins, an adhesion layer liquid coating composition containing thermally fusible resins, and if desired, liquid coating compositions, to form additional layers, are previously prepared and those liquid coating compositions are then applied onto the non-transferable releasing layer or the substrate in a predetermined order and subsequently dried. Each of the liquid coating compositions may be applied employing a conventional method known in the art. Further, a primer layer may be arranged between each of the layers.

UV Absorbing Agent

It is preferable that UV absorbing agents are incorporated in at least one of the thermally transferable protective layers.

When incorporated in a transparent resinous layer, the resulting transparent resinous layer is positioned as the surface of printed matter after transferring the protective layer. As a result, effects of UV absorbing agents decrease due to ambient influence over an extended period of time. Consequently, it is particularly preferable to incorporate UV absorbing agents in a heat-sensitive adhesive layer.

Listed as UV absorbers are salicylic acid based, benzophenone based, benzotriazole based, and cyanoacrylate based UV absorbing agents. Specifically, these are commercially available under trade names such as Tinuvin P, Tinuvin 234, Tinuvin 320, Tinuvin 326, Tinuvin 327, Tinuvin 328, Tinuvin 312, and Tinuvin 315 (all manufactured by Ciba-Geigy Corp.); Sumisorb-110, Sumisorb-130, Sumisorb-140, Sumisorb-200, Sumisorb-250, Sumisorb-300, Sumisorb-320, Sumisorb-340, Sumisorb-350, and Sumisorb-400 (all manufactured by Sumitomo Chemical Co., Ltd.); and Mark LA-32, Mark LA-36, and Mark 1413 (all manufactured by Adeka Argus Chemical Co., Ltd.). It is possible to use any of these in the present invention.

Further, it is possible to use random copolymers of a Tg of at least 60° C. and preferably at least 80° C., which are prepared by random polymerization of reactive UV absorbing agents with acryl based monomers.

Employed as the above reactive UV absorbing agents may be those prepared by introducing groups having an addition-polymerizable double bond, such as a vinyl group, an acryloyl group, or a methacryloyl group, or other groups such as an alcohol based hydroxyl group, an amino group, a carboxyl group, an epoxy group, or an isocyanate group into prior art non-reactive UV absorbing agents such as a salicylate based, benzophenone based, benzotriazole based, substituted acrylonitrile based, nickel chelate based, and hindered amine based UV absorbing agents. Specifically, these are commercially available under the trade names such as UVA635L and UVA633L (both manufactured by BASF Japan Ltd.) and PUVA-30M (manufactured by Otsuka Chemical Co., Ltd.). It is possible to use any of these in the present invention.

The amount of reactive UV absorbing agents in the above random copolymers with acryl based monomers is commonly in the range of 10–90 weight %, and is preferably in the range of 30–70 weight %. Further, the molecular weight of such random copolymers may be set commonly at about 5,000–about 250,000, and preferably at about 9,000–about 30,000. The foregoing UV absorbing agents and random copolymers of reactive UV absorbing agents with acryl based monomers may be incorporated individually or in combinations of both. The random copolymers of reactive UV absorbing agents with acryl based monomers are preferably incorporated in an amount ranging from 5–50 weight % with respect to the incorporated layer.

Of course, other than UV absorbing agents, other light resistant agents may be incorporated. As used herein, "light resistant agents" refer to chemical agents which minimize modification and decomposition of dyes by absorbing or shielding actions such as radiation energy, heat energy or oxidation which modify or decompose dyes. Other than the foregoing UV absorbing agents, examples include antioxidants and light stabilizers, both of which are conventionally known as additives for synthetic resins. In this case, these may be incorporated in at least one thermally transferable protective lawyer, namely in at least one of the foregoing peeling layer, the transparent resinous layer, or the heat-sensitive adhesion layer, and particularly preferably in the heat-sensitive adhesion layer.

Listed as antioxidants are phenol based, monophenol based, bisphenol based or amine based primary antioxidants, as well as sulfur based or phosphorus based secondary antioxidants. Further listed as light stabilizers are hindered amine based ones.

The used amount of the above-mentioned light resistant agents, including UV absorbing agents, is not particularly limited, and is preferably 0.05–10 weight parts with respect to 100 weight parts of resins to form a layer in which the foregoing agents are incorporated, but more preferably 3–10 weight parts. When the used amount is excessively small, it is difficult to achieve the desired effects of the light resistant agents, while an excessive amount is not cost effective.

Further, other than the above light resistant agents, it is possible to simultaneously add, to the adhesive layer, various types of additives such as fluorescent brightening agents or fillers in an appropriate amount.

The transparent resinous layer of the protective layer transfer sheet may be arranged individually on a substrate or following the ink layer of a thermal transfer sheet.

Heat Resistant Slipping Layer

In the thermal transfer sheet of this invention, it is preferable that a heat resistant slipping layer is arranged on the side opposite the dye layer across the substrate as a backing layer.

The foregoing heat resistant slipping layer is arranged for the purpose of minimizing adhesion of heating devices such as a thermal head with a substrate to achieve smooth transportation of the sheet and eliminate deposits on thermal heads.

Employed as resins in the foregoing heat resistant slipping layer are, for example, natural or synthetic resins including cellulose based resins such as ethyl cellulose, hydroxy cellulose, hydroxypropyl cellulose, methyl cellulose, cellulose acetate, cellulose acetate butyrate, or nitrocellulose, vinyl based resins such as polyvinyl alcohol, polyvinyl acetate, polyvinyl butyral, polyvinyl acetal, or polyvinylpyrrolidone, acryl based resins such as methyl polymethacrylate, ethyl polymethacrylate, polyacryl amide, acrylonitrile-styrene copolymers, polyimide resins, polyamide resins, polyamidoimide resins, polyvinyl toluene resins, coumarone indene resins, polyester based resins, polyurethane resins, and silicone-modified or fluorine-modified urethane. These may be used individually or in the form of mixtures. In order to enhance heat resistance of the heat resistant slipping layer, it is preferable that, of the above resins, resins having a hydroxyl group based reactive group are employed and a crosslinked resinous layer is formed by simultaneously employing polyisocyanate as a crosslinking agent.

Further, in order to provide sliding properties with thermal heads, solid or liquid releasing agents or lubricants may be added to the heat resistant slipping layer to result in heat resistant slipping properties. Employed as releasing agents or slipping agents may, for example, be various waxes such as polyethylene wax or paraffin wax, higher aliphatic alcohol, organopolysiloxane, anionic surface active agents, cationic surface active agents, amphoteric surface active agents, nonionic surface active agents, fluorine based surface active agents, metal soaps, organic carboxylic acids and derivatives thereof, fluororesins, silicone resins, and inorganic micro-particles such as talc or silica. The amount of slipping agents incorporated in the heat resistant slipping layer is commonly 5–50 weight %, and is preferably 10–30 weight %. It is possible to set the thickness of such a heat resistant slipping layer at about 0.1–10 μm and preferably at 0.3–5 μm.

Thermal Transfer Image Receiving Layer

The thermal transfer image receiving layer comprised of at least a substrate and a dye receiving layer of this invention will now be described.

In cases when the protective transfer layer unit is a multilayer of a protective transfer layer and an adhesive layer, the adhesive layer works to facilitate transfer of the protective transfer layer to the surface to be transferred. As adhesives formed this adhesive layer, employable are thermal fusible adhesives such as acryl, styreneacryl, vinyl chloride, styrene-vinyl chloride-vinyl acetate copolymer, and vinyl chloride-vinyl acetate copolymer. Formation of the adhesive layer is conducted with methods of well-known in the art such as a gravure coat method, gravure reverse coat method and a roll coat method. The thickness of the adhesive layer is preferably about 0.1–5 μm.

Substrate

A substrate employed for the thermal transfer image receiving sheet functions to hold a dye receiving layer. In addition, since heat is applied to the substrate during thermal transfer, it is preferable that the substrate exhibits mechanical strength under high heat to prevent handling problems.

Materials for such a substrate are not particularly limited. Listed as such materials are, for example, condenser paper, glassine paper, parchment paper, paper with a high degree of sizing, synthetic paper (either polyolefin based or polystyrene based), bond paper, art paper, coated paper, cast coated paper, wallpaper, lining paper, synthetic resin or emulsion impregnated paper, synthetic rubber latex impregnated paper, synthetic resin internally added paper, paper board, cellulose fiber paper, as well as films comprised of polyester, polyacrylate, polycarbonate, polyurethane, polyimide, polyetherimide, cellulose derivatives, polyethylene, ethylene-vinyl acetate copolymers, polypropylene, polystyrene, polyvinyl chloride, polyvinylidene chloride, polyvinyl alcohol, polyvinyl butyral, nylon, polyether ketone, polysulfone, polyethersulfone, tetrafluoroethylene, perfluoroalkyl vinyl ether, polyvinyl fluoride, tetrafluoroethylene-ethylene, tetrafluoroethylene-hexafluoropropylene, polychlorofluoroethylene, and polyvinylidene fluoride. Further, it is possible to use white opaque film prepared by casting synthetic resins containing white pigments and fillers and foamed sheets, for which no particular limitation is imposed.

Further, it is possible to use a laminated body composed of the above components in optional combinations. Listed as examples of representative laminated bodies are combinations of cellulose fiber paper and synthetic paper as well as cellulose synthetic paper and plastic film. The thickness of these component sheets is not limited but is commonly about 10–300 μm.

In order to achieve a higher printing rate and obtain higher quality resulting in neither uneven density nor white spots, it is preferable that a layer comprising minute voids is provided. Employed as layers provided with minute voids are plastic film and synthetic paper provided with minute voids in the interior. Further, it is possible to form, on various types of component sheets, a layer provided with minute voids, employing various types of coating systems. Preferably employed as plastic film or synthetic paper provided with minute voids are those which are prepared in such a manner that polyolefin, particularly polypropylene as a main component, inorganic pigments and/or polypropylene incompatible polymers are blended and these are employed as a void formation initiating agent and the resultant mixture is cast into film and oriented. When polyester is employed as a main component, the resultant cushioning properties as well as heat insulating properties are inferior to ones in which polypropylene is used as a main component, due to the viscoelastic and thermal properties, whereby photographic printing speed is degraded and uneven density tends to result.

When these aspects are taken into account, the elastic modulus of plastic film and synthetic paper is preferably $5\times10^{8}$–$1\times10^{10}$ Pa at 20° C. Further, these plastic films and synthetic papers are commonly formed through biaxial orientation, and consequently tend to shrink by heat. When these are allowed to stand at 110° C. for 60 seconds, the degree of shrinkage is customarily 0.5–2.5 percents. The above plastic films or synthetic papers may be composed of a single layer or a plurality of layers. When composed of a plurality of layers, all the layers may contain voids or there may be layer(S) containing no voids. If desired, white pigments as a shielding agent may be blended into the above plastic films and synthetic papers. Further, for an increase in whiteness, additives such as fluorescent brightening agents may be incorporated. It is preferable that the thickness of the minute void containing layer is 30–80 μm.

It is also possible to form a void containing layer employing a method in which coating is performed on a substrate. Employed as plastic resins are prior art resins such as polyester, urethane resins, polycarbonate, acryl resins, polyvinyl chloride, or polyvinyl acetate. These may be employed individually or in combinations of a plurality of types.

Further, if desired, for the purpose of minimizing curling, it is possible to provide, on the side opposite the side of a substrate on which an image receiving layer is applied, a layer composed of resins such as polyvinyl alcohol, polyvinylidene chloride, polyethylene, polypropylene, modified polyolefin, polyethylene terephthalate, or polycarbonate and synthetic paper. Employed as lamination methods may be, prior art lamination methods such as dry lamination, non-solvent (hot melt) lamination, or EC lamination. Of these, a dry lamination method as well as a non-solvent lamination method is preferred. Listed as suitable adhesives for the non-solvent lamination method are, for example, Takenate 720L, produced by Takeda Chemical Industries, Ltd., while listed as suitable adhesives for the dry lamination are, for example, Takeluck A969/Takenate A-5(3/1), produced by Takeda Chemical Industries, Ltd., and Polysol PSA SE-1400 and Vinylol PSA AV-620 Series, produced by Showa Highpolymer Co., Ltd. The amount of these adhesives used is about 1–about 8 g/m$^2$ in terms of solids, and is preferably 2–6 g/m$^2$.

When a single plastic film sheet and a single synthetic paper sheet, two plastic film sheets or two synthetic paper sheets, described above, and various types of paper sheets with a single plastic film sheet and a single synthetic paper sheet are laminated, it is possible to join them via an adhesive layer.

For the purpose of enhancing the adhesion strength between the above-mentioned substrate and the dye receiving layer, it is preferable to apply various types of primer treatments or a corona discharge treatment.

Binder Resin

It is possible to use prior art binder resins in the thermal transfer image receiving layer of this invention. Of these, it is preferable to use binders which are readily colored with dyes. Specifically, it is possible to use polyolefin resins such as polypropylene, halogenated resins such as polyvinyl chloride or polyvinylidene chloride, vinyl based resins such as polyvinyl acetate or polyacrylic acid ester, polyester resins such as polyethylene terephthalate or polybutylene terephthalate, polystyrene resins, polyamide resins, phenoxy resins, copolymers of olefin such as ethylene or propylene with other vinyl based monomers, polyurethanes, polycarbonate, acryl resins, ionomers, compounds such as cellulose derivatives or mixtures thereof. Of these, preferred are polyester based resins, vinyl based resins, and cellulose derivatives.

Releasing Agent

To the thermally transferable dye receiving layer of this invention, it is preferable to add releasing agents, for the purpose of minimizing thermal fusion of the dye receiving layer with an ink layer. Employed as releasing agents may be phosphoric acid ester based plasticizers, fluorine based compounds, and silicone oil (including reactive curing type silicones). Of these, silicone oil is preferred. Employed as silicone oil may be various types of modified silicone including dimethyl silicone. Specific examples include amino-modified silicone, epoxy-modified silicone, alcohol-modified silicone, vinyl-modified silicone, and urethane-modified silicone. These may be blended and then applied, while they may undergo polymerization employing various reactions and then applied. Releasing agents may be employed individually or in combinations of at least two types. Further the added amount of releasing agents is preferably 0.5–30 weight parts with respect to 100 weight parts of dye receiving layer forming resins. When the added amount is beyond the foregoing range, problems occasionally occur in which a thermal transfer sheet fuses with the dye receiving layer of the thermal transfer image receiving sheet or printing photographic speed is lowered. Incidentally, these releasing agents may not be incorporated in the dye image receiving layer, but it may separately form a releasing layer on the dye receiving layer.

Metal Ion Compound

In the thermally transferable dye receiving layer of this invention, it is preferable to incorporate metal ion containing compounds (hereinafter, also referred to as metal sources) as dye fixing agents.

Listed as metal sources are inorganic and organic salts of metal ions and metal complexes. Of these, preferred are organic acid salts and complexes. Listed as metals are univalent and multivalent metals which belong to Groups I–VIII of the periodic table. Of these, preferred are Al, Co, Cr, Cu, Fe, Mg, Mn, Mo, Ni, Sn, Ti, and Zn, and specifically preferred are Ni, Cu, Cr, Co, and Zn. Listed as specific examples of metal sources are salts of aliphatic compounds such as acetic acid or stearic acid with $Ni^{2+}$, $Cu^{2+}$, $Cr^{2+}$, $Co^{2+}$, or $Zn^{2+}$, or salts of aromatic carboxylic acids such as benzoic acid or salicylic acid.

In the present invention, specifically preferred as metal sources are the complexes represented by Formula (I-m) below, since it is possible to add them to binder resins without any problem and they are substantially colorless.

$$[M(Q_1)_X(Q_2)_Y(Q_3)_Z]^{P+}(L^-)_P \qquad \text{Formula (I-m)}$$

In above Formula (1-m), M is a metal ion, and preferably is $Ni^{2+}$, $Cu^{2+}$, $Cr^{2+}$, $Co^{2+}$, or $Zn^{2+}$. $Q_1$, $Q_2$, and $Q_3$ are each a coordination compound capable of forming a coordination bond with a metal ion represented by M, and each may be the same or different among them. It is possible to select such coordination compounds from those, described, for example, in Kireto Kagaku (being Chelate Science) (5), published by Nanko Do. L– is an organic anion group, and specifically, it is possible to list tetraphenylboron anions and alkylbenzenesufonic acid anions. X is 1, 2, or 3, Y is 1, 2, or 0, and Z is 1 or 0, while P is 1 or 2. Listed as specific examples of such types of metal sources may be compounds exemplified in U.S. Pat. No. 4,987,049 as well as Compounds No. 1–99 exemplified in JP-A 9-39423. Particularly preferred compounds are those represented by Formula (II-m) below, described in JP-A 10-241410.

$$M^{2+}(X_1^-)_2 \qquad \text{Formula (II-m)}$$

In above Formula (II-m), $M^{2+}$ is a divalent transition metal ion. Of these, in view of the color of metal ion providing compounds and the color tone of chelated dyes, nickel and zinc are preferred. $X_1^-$ is a coordination compound capable of forming a complex with divalent metal ions. Further, these compounds may have neutral ligands in response to the central atom, and $H_2O$ and $NH_3$ are listed as representative ligands.

Interlayer

Further, in the thermal transfer image receiving sheet, an interlayer may be provided between the substrate and the transferable dye receiving layer. As used in the present invention, the term "interlayer" refers to all the layers between the substrate and the transferable dye receiving layer, and may be multilayered. Listed as functions of the interlayer are a solvent resistant function, a barrier function, an adhesion function, a whiteness providing function, a covering function, and an antistatic function. However, the functions are not limited thereto, and it is possible to employ all appropriate conventional interlayers known in the art.

In order to provide an interlayer with solvent resistance as well as a barrier function, it is preferable to use water-soluble resins. Listed as such water-soluble resins are cellulose based resins such as carboxymethyl cellulose; polysaccharide based resins such as starch; proteins such as casein, gelatin, or agar; vinyl based resins such as polyvinyl alcohol, ethylene-vinyl acetate copolymers, polyvinyl acetate, vinyl chloride-vinyl acetate copolymers (e.g., Veova, produced by Japan Epoxy Resins Co., Ltd.), vinyl acetate-(meth)acryl copolymers, (meth)acryl resins, styrene-(meth)acryl copolymers, styrene resins, and polyamide based resins such as melamine resins, urea resins, or benzoguanamine resins, polyester, and polyurethane. Water-soluble resins, as described herein, refer to resins which are completely dissolved (a particle diameter of at most 0.01 μm) in solvents comprised of water as a main component, or result in a state of colloidal dispersion (0.01–0.1 μm) or slurry (at least 1 μm). Of these water-soluble resins, particularly preferred are those which are neither dissolved in nor swelled by alcohols such as methanol, ethanol, or isopropyl alcohol, or general purpose solvents such as hexane, cyclohexane, acetone, methyl ethyl ketone, xylene, ethyl acetate, butyl acetate, or toluene. In this respect, most preferred are resins which are completely dissolved in solvents containing water as a main component. Specifically preferred are a polyvinyl alcohol resin and a cellulose resin.

In order to provide an interlayer performing an adhesion function, urethane resins and polyolefin based resins are commonly employed, though resins may differ depending on the type of substrates and surface treatments. Further, when thermoplastic resins having active hydrogen and curing agents such as isocyanate compounds are simultaneously employed, desired adhesion function is obtained. In order to allow an interlayer to provide a whiteness function, it is possible to use fluorescent brightening agents. Listed as usable fluorescent brightening agents may be any of the conventional compounds known in the art. Listed as fluorescent whitening agents are stilbene based, distilbene based, benzoxazole based, styryl-oxazole based, pyreneoxazole based, coumarin based, aminocoumarin based, imidazole based, benzimidazole based, pyrazolone based, and distyryl-biphenyl based fluorescent brightening agents. It is possible to control whiteness based on the type of these fluorescent brightening agents and the added amount thereof. Fluorescent brightening agents may be added employing any of appropriate methods. Namely, listed is a method in which they are dissolved in water and then added, a method in which they are crushed and dispersed employing a ball mill or a colloid mill and then added, a method in which they are dissolved in high boiling point organic solvents, mixed with a hydrophilic colloidal solution and then added in the form of oil-in-water type dispersion, or a method in which thy are impregnated in polymer latex and then added.

Further, in order to minimize a feeling of glare and unevenness of substrates, titanium oxide may be incorporated in the interlayer. In addition, the use of titanium oxide is preferred since it provides a greater degree of freedom for selecting substrates. Titanium oxide includes two types, namely rutile type titanium oxide and anatase type titanium oxide. When whiteness and desired effects of fluorescent brightening agents are considered, anatase type titanium oxide which exhibits absorption of the ultraviolet region at a shorter wavelength side than rutile type titanium oxide is preferred. In the cases when it is difficult to disperse titanium oxide due to the fact that the binder resins of the interlayer are water-based, dispersion may be performed by employing titanium oxide which is subjected to a hydrophilic surface treatment, conventional dispersing agents or known surface active agents such as ethylene glycol. The added amount of titanium oxide is preferably 10–400 weight parts in terms of solids with respect to 100 weight parts of the resinous solids.

In order to provide an antistatic function to an interlayer, prior art electrically conductive materials such as electrically conductive inorganic fillers and electrically conductive organic materials such as polyanilinesulfonic acid may be selected and then used while matching with the binder resins of the interlayer. The thickness of such an interlayer is preferably set at about 0.1–10 μm.

Image Forming Method

Figure 2:
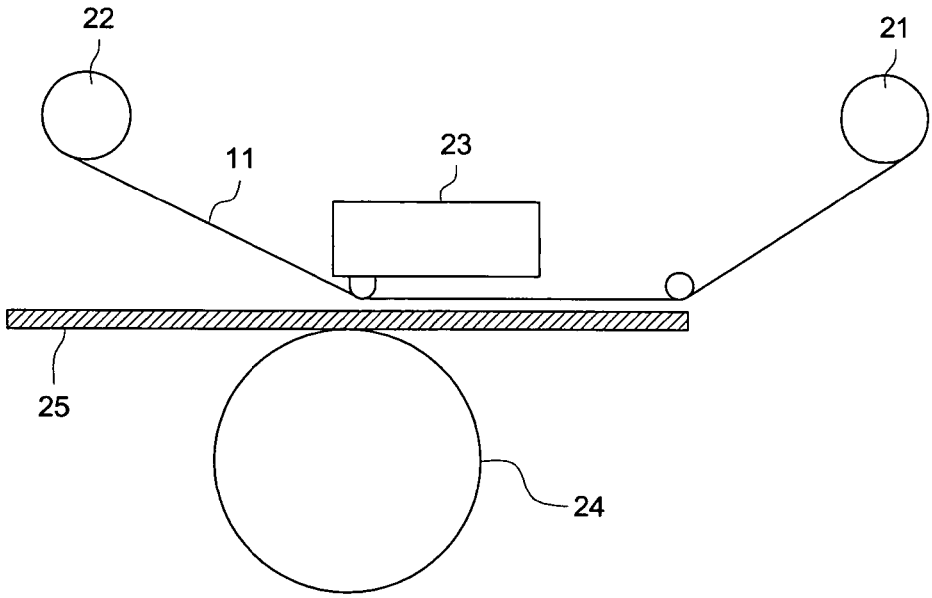
FIG. 2 is a view showing a frame format of a thermal transfer recording apparatus employed in this invention.

As a thermal transfer recording apparatus employable for an image forming method of this invention, for example, an apparatus shown in FIG. 2 may be used. In FIG. 2, 21 is a supply roller of a thermal transfer sheet, 11 is a thermal transfer sheet, 22 is a winding roller of the used thermal transfer sheet, 24 is a platen roller, and 25 is a thermal transfer image receiving sheet which is inserted between Thermal Head 23 and Platen Roller 24. While, 12 is a substrate.

An image forming process, using a thermal transfer recording apparatus shown in FIG. 2 and a thermal transfer sheet, for example, shown in FIG. 1, will be described. First, Ink Layer 13Y containing a yellow dye of a thermal transfer sheet shown in FIG. 1 is superimposed to an image receiving layer of Thermal Transfer Receiving Sheet 25, after which a yellow dye in Ink Layer 13Y is transferred by heat application with Thermal Head 23 to an image receiving sheet based on image data. Next, onto this yellow image, in the same manner, a magenta dye is transferred imagewise from Ink Layer 13M containing a magenta dye, and then, onto this magenta image, in the same manner, a cyan dye is transferred imagewise from Ink Layer 13C containing a cyan dye. Finally, onto the all area of the image, Transferable Protective Layer Unit 14 containing transferable protective layer is-thermally transferred from the thermal transfer sheet to complete an image formation.

In a thermal transfer recording apparatus employed in this invention, in cases when a glossy surface or a matte surface may be chosen by controlling the apparatus, it is preferred to obtain desirable surface printing with one model of machine. A method to chose the surface is not specifically limited. For example, holding control data corresponding to a glossy surface or a matte surface of this invention in a thermal transfer recording apparatus, a controlling section may be controlled based on the chosen data which is read out by an operator with a simple operation. Or, in cases when a PC is connected to the recording apparatus, the control data may be stored in the PC to send out the data to the recording apparatus with a simple operation by an operator. Further, in cases when the sheet is heated with a heat roller, by superimposing a material capable of changing surface properties such as a releasing sheet to give glossiness or a patterned idented surface sheet for a matte surface onto the image receiving layer surface after image recording, and by heating the sheet from the reverse side with a heat roller, different surfaced recorded materials can be obtained.

EXAMPLE

The present invention will now be specifically described with reference to examples. However, the present invention is not limited thereto. In the Example, "part" and "%" are each "weight part" and "weight %", unless otherwise noted.

Example 1

Preparation of Thermal Transfer Sheets 1–17

Preparation of Substrate

Onto the one surface of a 6 μm thick polyethylene terephthalate film (being K-203E-6F, produced by Diafoil Hoechst Co., Ltd.), provided was a 0.5 μm thick primer layer comprising urethane based resin. Onto the other side of the substrate, a 1.0 μm thick silicone resin layer was provided as a heat resistant slipping layer, to prepare a substrate for a thermal transfer sheet.

Preparation of Thermal Transfer Sheet

Onto the surface side provided a primer layer, of the substrate for a thermal transfer sheet, each of the ink layers containing a yellow dye, a magenta dye and a cyan dye respectively and composed of the following contents, was coated in the combination described in Table 2 with a gravure coat method, so that the solid amount after drying of each ink layer was 0.7 g/m$^2$ in the order of the following layers on the same side of the substrate, to obtain Thermal Transfer Sheets 1–7 after drying.

| Preparation of Coating Composition of Yellow Ink Layer | |
|---|---|
| Yellow dye (exemplified dye described in Table 2) | 1.0 part |
| Polyvinylbutyral (being KY-24, produced by Denki Kagaku Kogyo Kabusiki Kaisha) | 5.5 parts |
| Urethane modified silicone resin (being Daiaromer SP-2105, produced by Dainichiseika Color & Chemicals Mfg. Co., Ltd.) | 1.5 parts |
| Methyl ethyl ketone | 80.0 parts |
| Butyl acetate | 10.0 parts |

| Preparation of Coating Composition of Magenta Ink Layer | |
|---|---|
| Magenta dye (exemplified dye described in Table 2) | 1.0 part |
| Polyvinylbutyral (being KY-24, produced by Denki Kagaku Kogyo Kabusiki Kaisha) | 5.5 parts |
| Urethane modified silicone resin (being Daiaromer SP-2105, produced by Dainichiseika Color & Chemicals Mfg. Co., Ltd.) | 1.5 parts |
| Methyl ethyl ketone | 80.0 parts |
| Butyl acetate | 10.0 parts |

| Preparation of Coating Composition of Cyan Ink Layer | |
|---|---|
| Cyan dye (exemplified dye described in Table 2) | 1.0 part |
| Polyvinylbutyral (being KY-24, produced by Denki Kagaku Kogyo Kabusiki Kaisha) | 5.5 parts |
| Urethane modified silicone resin (being Daiaromer SP-2105, produced by Dainichiseika Color & Chemicals Mfg. Co., Ltd.) | 1.5 parts |
| Methyl ethyl ketone | 80.0 parts |
| Butyl acetate | 10.0 parts |

In each of ink layers described in Table 2, in cases when two kinds of dyes were used, the ratio of them was 1:1.

Preparation of Thermal Transfer Sheet 18–34

Thermal Transfer Sheets 18–34 were prepared in the same manner as above Thermal Transfer Sheets 1–7, except that a three layered, transparent protective layer which consisted of the following components, was coated on the substrate. The three layers were, in the order from the support, a releasing layer (coated with a gravure coating method, being a solid content of 0.4 g/m$^2$ after drying), a transferable transparent protective layer (coated with a gravure coating method, being a solid content of 2.0 g/m$^2$ after drying) and a transparent adhesive layer (coated with a gravure coating method, being a solid content of 1.0 g/m$^2$ after drying).

| Coating Composition of Releasing Layer | |
|---|---|
| Inorganic micro-particles (being colloidal silica, produced by Nissan Chemical Industries, Ltd.) | 10.0 parts |

-continued

| Coating Composition of Releasing Layer | |
|---|---|
| Polyvinyl alcohol (produced by The Nippon Synthetic Chemical Industry Co., Ltd.) | 8.0 parts |
| Water | 50.0 parts |
| Ethanol | 40.0 parts |

| Coating Composition of Transparent Protective Layer | |
|---|---|
| Vinyl chloride/vinyl acetate copolymer (being #1000A, produced by Denki Kagaku Kogyo Kabushiki Kaisha) | 15.0 parts |
| Copolymer resin reacted and bonded with a reactive ultraviolet ray absorbing agent (being UVA635L, produced by BASF Japan Ltd.) | 20.0 parts |
| Methyl ethyl ketone | 50.0 parts |
| Toluene | 50.0 parts |

| Coating Composition of Adhesive Layer | |
|---|---|
| Vinyl chloride/vinyl acetate copolymer (being #1000A, produced by Denki Kagaku Kogyo Kabushiki Kaisha) | 20.0 parts |
| Micro silica | 1.0 part |
| Methyl ethyl ketone | 40.0 parts |
| Toluene | 40.0 parts |

TABLE 2

| Thermal Transfer Sheet No. | Yellow Ink Layer Yellow Dye | Magenta Ink Layer Magenta Dye | Cyan Ink Layer Cyan Dye | Transparent Protective Layer | Remarks |
|---|---|---|---|---|---|
| 1 | Y-1 | M-2 | C-5 | — | Inv. |
| 2 | Y-2 | M-2 | C-9 | — | Inv. |
| 3 | Y-2 | M-2 | C-8 | — | Comp. |
| 4 | Y-3 | M-7 | C-11 | — | Inv. |
| 5 | Y-3 | M-7 | C-9 | — | Inv. |
| 6 | Y-3 | M-7 | C-7 | — | Comp. |
| 7 | Y-6 | M-5 | C-10 | — | Inv. |
| 8 | Y-6 | M-5 | C-9 | — | Inv. |
| 9 | Y-6 | M-5 | C-4 | — | Comp. |
| 10 | Y-2 | M-1 | C-3 | — | Comp. |
| 11 | Y-2, Y-3 | M-1, M-2 | C-5, C-9 | — | Inv. |
| 12 | Y-4, Y-5 | M-3, M-4 | C-5, C-10 | — | Inv. |
| 13 | Y-2, Y-3 | M-2, M-5 | C-5, C-9 | — | Inv. |
| 14 | Y-5 | M-2, M-5 | C-6 | — | Inv. |
| 15 | Y-5 | M-2, M-5 | C-9 | — | Inv. |
| 16 | Y-5 | M-2, M-5 | C-3, C-11 | — | Inv. |
| 17 | Y-5, Y-6 | M-2, M-5 | C-3, C-11 | — | Inv. |
| 18 | Y-1 | M-2 | C-5 | Presence | Inv. |
| 19 | Y-2 | M-2 | C-9 | Presence | Inv. |
| 20 | Y-2 | M-2 | C-8 | Presence | Comp. |
| 21 | Y-3 | M-7 | C-11 | Presence | Inv. |
| 22 | Y-3 | M-7 | C-9 | Presence | Inv. |
| 23 | Y-3 | M-7 | C-7 | Presence | Comp. |
| 24 | Y-6 | M-5 | C-10 | Presence | Inv. |
| 25 | Y-6 | M-5 | C-9 | Presence | Inv. |
| 26 | Y-6 | M-5 | C-4 | Presence | Comp. |
| 27 | Y-2 | M-1 | C-3 | Presence | Comp. |
| 28 | Y-2, Y-3 | M-1, M-2 | C-5, C-9 | Presence | Inv. |
| 29 | Y-4, Y-5 | M-3, M-4 | C-5, C-10 | Presence | Inv. |
| 30 | Y-2, Y-3 | M-2, M-5 | C-5, C-9 | Presence | Inv. |
| 31 | Y-5 | M-2, M-5 | C-6 | Presence | Inv. |
| 32 | Y-5 | M-2, M-5 | C-9 | Presence | Inv. |

TABLE 2-continued

| Thermal Transfer Sheet No. | Yellow Ink Layer Yellow Dye | Magenta Ink Layer Magenta Dye | Cyan Ink Layer Cyan Dye | Transparent Protective Layer | Remarks |
|---|---|---|---|---|---|
| 33 | Y-5 | M-2, M-5 | C-3, C-11 | Presence | Inv. |
| 34 | Y-5, Y-6 | M-2, M-5 | C-3, C-11 | Presence | Inv. |

Note:
Comp.: Comparative example
Inv.: This invention

Preparation of Image Receiving Sheet

Preparation of Substrate 1

All of the 1st Layer Coating Composition, the 2nd Layer Coating Composition and the 3rd Layer Coating Composition, each consisted of the following components, were extruded at the same time at 300° C. using an extruder, and formed a three layered sheet on a stainless belt, after which the sheet was cooled and solidified to prepare film. As the film was transported using rollers heated to 115° C., the film was stretched in the factor of three to the transport direction. Subsequently, the both sides of film were held with clips and the film was stretched in the factor of three at right angles to the transport direction. Then, heat setting was conducted at 200° C., and annealed to a room temperature to prepare Sheet A (hereinafter, referred to as Porous PET Sheet), which was a porous polyethylene terephthalate film exhibiting a gravity of 0.7, the 1st layer being 8.0 μm, the 2nd layer being 35 μm and the 3rd layer being 8 μm.

Components of Each Layer

| | | |
|---|---|---|
| The 1st Layer: | PET | |
| The 2nd Layer: | PET | 90 parts |
| | PET-PTMG [at polymerization of PET, PTMG (being polytetramethylene glycol, having a molecular weight of 4,000) was added to become the weight ratio of them being 1:1] | 1.0 part |
| | Syndiotactic styrene (Xarec S10, produced by Idemitsu Petrochemical Co., Ltd., currently Idemitsu Kosan Co., Ltd.) | 6 parts |
| The 3rd Layer: | PET | |

Both sides of Porous PET Sheet as prepared above were subjected to corona discharge treatment by the law of the art. Subsequently, onto the one side of bond paper having a weight of 130 g/m$^2$ and thickness of 110 μm, above Porous PET Sheet was pasted through a 140° C. laminator using an adhesion of Polysol PSA SE-1400 (produced by Showa Highpolymer Co., Ltd.). Onto the other side of the paper, low density polyethylene having a density of 0.92 and containing anatase type titanium oxide of 9.5 weight %, was coated with a melt extrusion method at a thickness of 40 μm to obtain Substrate 1 for an image receiving sheet.

Preparation of Image Receiving Sheet 1

Onto the Porous PET Sheet side of above Substrate 1 for an image receiving sheet, a subbing layer coating composition consisted of the following contents was coated and dried at 120° C. for one minute to form a subbing layer.

Subsequently, onto that layer, Image Receiving Layer Coating Composition 1 consisted of the following contents was coated so that the solid content became 2.5 g/m$^2$ after drying and dried at 130° C. for two minutes to obtain an image receiving layer. After that, rolls of Image Receiving Sheet 1 were prepared by slitting the above coated sheet by 152 mm width.

| Preparation of Subbing Layer coating Composition | |
|---|---|
| Acrylic emulsion (Nikasol A-08, produced by Nippon Carbide Industries Co., Inc.) being a 35% aqueous solution | 5.7 parts |
| Purified water | 94.0 parts |

| Preparation of Image Receiving Layer Coating Composition | |
|---|---|
| Vinyl chloride/vinyl acetate copolymer Resin (being #1000 GK, produced by Denki Kagaku Kogyo Kabushiki Kaisha) | 42.0 parts |
| Metal source (MS-1: *1) | 18.0 parts |
| Epoxy modified silicone (being KF-393, Produced by Shin-Etsu Chemical Co., Ltd.) | 0.7 parts |
| Amino modified silicone (being KS-343, produced by Shin-Etsu Chemical Co., Ltd.) | 0.3 parts |
| Methyl ethyl ketone | 20.0 parts |
| Toluene | 20.0 parts |

*1: MS-1: $Ni^{2+}[C_7H_{15}COC(COOCH_3)=C(CH_3)O—]_2$

Preparation of Image Receiving Sheet 2

Image Receiving Sheet 2 was prepared in the same manner as above Image Receiving Sheet 1, except that Image Receiving Layer Coating Composition 1 was replaced by Image Receiving Layer Coating Composition 2 consisted of the following contents.

| Preparation of Image Receiving Layer Coating Composition 2 | |
|---|---|
| Vinyl chloride/vinyl acetate copolymer Resin (being #1000 GK, produced by Denki Kagaku Kogyo Kabushiki Kaisha) | 36.0 parts |
| Metal source (MS-1) | 24.0 parts |
| Epoxy modified silicone (being KF-393, Produced by Shin-Etsu Chemical Co., Ltd.) | 0.7 parts |
| Amino modified silicone (being KS-343, produced by Shin-Etsu Chemical Co., Ltd.) | 0.3 parts |
| Methyl ethyl ketone | 20.0 parts |
| Toluene | 20.0 parts |

Formation of Image

Image Forming Method 1

The image receiving layer portion of Image Receiving Sheet 1 prepared above and the ink layers of Thermal Transfer Sheets 1–7 were superimposed and set in a thermal transfer apparatus fitted with a 300 dpi (hereinafter dpi represents the number of dots per inch, being 2.54 cm) line thermal head in which the resistor shape was rectangular (having a length in the primary scanning direction of 80 μm×a length in the secondary scanning direction of 120 μm). While the thermal head was being brought into pressure contact with the platen roller, dyes were transferred onto the image receiving layer while heating the reverse side of the ink layer at a feed rate of 7 msec./line and a feed length per line of 85 μm in such a neutral step pattern (being a three color surprint of yellow, magenta and cyan) that applied energy was successively increased in the range of 5–80 mJ/mm$^2$, whereby Printed Samples 1–7 were prepared.

Subsequently, Printed Samples 35–51 were prepared in the same manner as above, except that Image Receiving Sheet 1 was changed to Image Receiving Sheet 2.

Image Forming Method 2

The image receiving layer portion of Image Receiving Sheet 1 prepared above and the ink layers of Thermal Transfer Sheets 18–34 were superimposed and set in a thermal transfer apparatus fitted with a 300 dpi (hereinafter dpi represents the number of dots per inch, being 2.54 cm) line thermal head in which the resistor shape was rectangular (having a length in the primary scanning direction of 80 μm×a length in the secondary scanning direction of 120 μm). While the thermal head was being brought into pressure contact with the platen roller, dyes were transferred onto the image receiving layer while heating the reverse side of the ink layer at a feed rate of 7 msec./line and a feed length per line of 85 μm in such a neutral step pattern (being a three color surprint of yellow, magenta and cyan) that applied energy was successively increased in the range of 5–80 mJ/mm$^2$. Subsequently, the transferable transparent protective layer was heated from the rear side of the substrate to transfer the transparent protective layer on the image receiving layer, whereby Printed Samples 18–34 were prepared.

Evaluation of Formed Image

Printed Samples 1-51 prepared above were evaluated based on the following methods.

Evaluation of Light Stability

A half of neutral step patterns on each printed sample prepared above was shield and radiated with Xenon Weather-O-Meter (being at 70,000 lux. and at 24° C. in a chamber, manufactured by Atlas Electric Devices Co.) for 14 days, after which color changes between the radiated area and the shield area were visually observed to evaluate light stability (color stability) based on the following criteria.

A: No color change was observed between both areas.

B: Slight color change was observed, but not at a problem from a practical viewpoint.

C: Color difference between both areas was obvious, and the quality was practically problematic.

Evaluation of Bleeding Resistance

Each of the neutral step pattern images were stored at 60° C. and 80% RH in a conditioning oven for one month, after which the image end area of the maximum density image pattern was visually observed to evaluate Bleeding Resistance based on the following criteria.

A: No bleeding was observed.

B: Slight bleeding was observed.

C: Obvious bleeding was observed.

Evaluation of Abrasion Resistance

Each of the neutral step pattern image surfaces was scrubbed with a plastic eraser by load of 2 N for 20 reciprocating, after which the status of the image and the protective layer was visually observed to evaluate Abrasion Resistance based on the following criteria.

A: No change was observed on the image.

B: Slight change was observed on the image surface or the protective layer surface.

C: Changes were observed on the image surface or the protective layer surface.

D: Obvious changes were observed on the image surface or the protective layer surface.

Obtained results in the above evaluations are shown in Table 3.

TABLE 3

| Image sample | Thermal transfer sheet | Protective layer presence/absence | Image receiving sheet | Printing rate msec/line | Light stability | Bleeding resistance | Abrasion resistance | Remarks |
|---|---|---|---|---|---|---|---|---|
| 1 | 1 | Absence | 1 | 7.0 | A | A | B | Inv. |
| 2 | 2 | Absence | 1 | 7.0 | B | B | B | Inv. |
| 3 | 3 | Absence | 1 | 7.0 | C | C | C | Comp. |
| 4 | 4 | Absence | 1 | 7.0 | A | A | B | Inv. |
| 5 | 5 | Absence | 1 | 7.0 | B | B | B | Inv. |
| 6 | 6 | Absence | 1 | 7.0 | C | C | B | Comp. |
| 7 | 7 | Absence | 1 | 7.0 | A | A | B | Inv. |
| 8 | 8 | Absence | 1 | 7.0 | B | B | B | Inv. |
| 9 | 9 | Absence | 1 | 7.0 | C | C | C | Comp. |
| 10 | 10 | Absence | 1 | 7.0 | C | C | B | Comp. |
| 11 | 11 | Absence | 1 | 7.0 | A | A | B | Inv. |
| 12 | 12 | Absence | 1 | 7.0 | A | A | B | Inv. |
| 13 | 13 | Absence | 1 | 7.0 | A | A | B | Inv. |
| 14 | 14 | Absence | 1 | 7.0 | A | A | B | Inv. |
| 15 | 15 | Absence | 1 | 7.0 | B | B | B | Inv. |
| 16 | 16 | Absence | 1 | 7.0 | A | A | B | Inv. |
| 17 | 17 | Absence | 1 | 7.0 | A | A | B | Inv. |
| 18 | 18 | Presence | 1 | 7.0 | A | A | A | Inv. |
| 19 | 19 | Presence | 1 | 7.0 | A | A | A | Inv. |
| 20 | 20 | Presence | 1 | 7.0 | C | C | B | Comp. |
| 21 | 21 | Presence | 1 | 7.0 | A | A | A | Inv. |
| 22 | 22 | Presence | 1 | 7.0 | A | A | A | Inv. |
| 23 | 23 | Presence | 1 | 7.0 | C | C | A | Comp. |
| 24 | 24 | Presence | 1 | 7.0 | A | A | A | Inv. |
| 25 | 25 | Presence | 1 | 7.0 | A | A | A | Inv. |
| 26 | 26 | Presence | 1 | 7.0 | C | C | B | Comp. |
| 27 | 27 | Presence | 1 | 7.0 | C | C | A | Comp. |
| 28 | 28 | Presence | 1 | 7.0 | A | A | A | Inv. |
| 29 | 29 | Presence | 1 | 7.0 | A | A | A | Inv. |
| 30 | 30 | Presence | 1 | 7.0 | A | A | A | Inv. |

TABLE 3-continued

| Image sample | Thermal transfer sheet | Protective layer presence/ absence | Image receiving sheet | Printing rate msec/ line | Light stability | Bleeding resistance | Abrasion resistance | Remarks |
|---|---|---|---|---|---|---|---|---|
| 31 | 31 | Presence | 1 | 7.0 | A | A | A | Inv. |
| 32 | 32 | Presence | 1 | 7.0 | A | A | A | Inv. |
| 33 | 33 | Presence | 1 | 7.0 | A | A | A | Inv. |
| 34 | 34 | Presence | 1 | 7.0 | A | A | A | Inv. |
| 35 | 1 | Absence | 2 | 7.0 | A | A | B | Inv. |
| 36 | 2 | Absence | 2 | 7.0 | A | A | B | Inv. |
| 37 | 3 | Absence | 2 | 7.0 | C | C | C | Comp. |
| 38 | 4 | Absence | 2 | 7.0 | A | A | B | Inv. |
| 39 | 5 | Absence | 2 | 7.0 | A | A | B | Inv. |
| 40 | 6 | Absence | 2 | 7.0 | C | C | B | Comp. |
| 41 | 7 | Absence | 2 | 7.0 | A | A | B | Inv. |
| 42 | 8 | Absence | 2 | 7.0 | A | A | B | Inv. |
| 43 | 9 | Absence | 2 | 7.0 | C | C | C | Comp. |
| 44 | 10 | Absence | 2 | 7.0 | C | C | C | Comp. |
| 45 | 11 | Absence | 2 | 7.0 | A | A | B | Inv. |
| 46 | 12 | Absence | 2 | 7.0 | A | A | B | Inv. |
| 47 | 13 | Absence | 2 | 7.0 | A | A | B | Inv. |
| 48 | 14 | Absence | 2 | 7.0 | A | A | B | Inv. |
| 49 | 15 | Absence | 2 | 7.0 | A | A | B | Inv. |
| 50 | 16 | Absence | 2 | 7.0 | A | A | B | Inv. |
| 51 | 17 | Absence | 2 | 7.0 | A | A | B | Inv. |

From the results in Table 3, it is proved that the printed image formed by using thermally transferable dyes having characteristics defined by Formula (1) of this invention, is superior in light stability and bleeding resistance compared to the comparative samples. Further, it is proved that by provision of a transferable protective layer, abrasion resistance is enhanced without impairing light stability and bleeding resistance.

Example 2

Printed samples 52–102 were prepared in the same manner as in preparation of Printed Samples 1–51 in Example 1, except that feed rate of the thermal head at printing of a yellow image, a magenta image and a cyan image was changed to 2.5 msec./line.

Regarding Printed Samples 52–102, evaluation of light stability, background whiteness and adhesiveness of the protective layer was conducted in the same manner as Example 1, results of which are shown in Table 4.

TABLE 4

| Printed sample | Thermal transfer sheet | Protective layer presence/ absence | Image receiving sheet | Printing rate msec/ line | Light stability | Bleeding resistance | Abrasion resistance | Remarks |
|---|---|---|---|---|---|---|---|---|
| 52 | 1 | Absence | 1 | 2.5 | A | A | B | Inv. |
| 53 | 2 | Absence | 1 | 2.5 | B | B | B | Inv. |
| 54 | 3 | Absence | 1 | 2.5 | C | C | C | Comp. |
| 55 | 4 | Absence | 1 | 2.5 | A | A | B | Inv. |
| 56 | 5 | Absence | 1 | 2.5 | B | B | B | Inv. |
| 57 | 6 | Absence | 1 | 2.5 | C | C | B | Comp. |
| 58 | 7 | Absence | 1 | 2.5 | A | A | B | Inv. |
| 59 | 8 | Absence | 1 | 2.5 | B | B | B | Inv. |
| 60 | 9 | Absence | 1 | 2.5 | C | C | C | Comp. |
| 61 | 10 | Absence | 1 | 2.5 | C | C | B | Comp. |
| 62 | 11 | Absence | 1 | 2.5 | A | A | B | Inv. |
| 63 | 12 | Absence | 1 | 2.5 | A | A | B | Inv. |
| 64 | 13 | Absence | 1 | 2.5 | A | A | B | Inv. |
| 65 | 14 | Absence | 1 | 2.5 | A | A | B | Inv. |
| 66 | 15 | Absence | 1 | 2.5 | B | B | B | Inv. |
| 67 | 16 | Absence | 1 | 2.5 | A | A | B | Inv. |

TABLE 4-continued

| Printed sample | Thermal transfer sheet | Protective layer presence/ absence | Image receiving sheet | Printing rate msec/ line | Light stability | Bleeding resistance | Abrasion resistance | Remarks |
|---|---|---|---|---|---|---|---|---|
| 68 | 17 | Absence | 1 | 2.5 | A | A | B | Inv. |
| 69 | 18 | Presence | 1 | 2.5 | A | A | A | Inv. |
| 70 | 19 | Presence | 1 | 2.5 | B | B | A | Inv. |
| 71 | 20 | Presence | 1 | 2.5 | C | C | B | Comp. |
| 72 | 21 | Presence | 1 | 2.5 | A | A | A | Inv. |
| 73 | 22 | Presence | 1 | 2.5 | B | B | A | Inv. |
| 74 | 23 | Presence | 1 | 2.5 | C | C | A | Comp. |
| 75 | 24 | Presence | 1 | 2.5 | A | A | A | Inv. |
| 76 | 25 | Presence | 1 | 2.5 | B | B | A | Inv. |
| 77 | 26 | Presence | 1 | 2.5 | C | C | B | Comp. |
| 78 | 27 | Presence | 1 | 2.5 | C | C | A | Comp. |
| 79 | 28 | Presence | 1 | 2.5 | A | A | A | Inv. |
| 80 | 29 | Presence | 1 | 2.5 | A | A | A | Inv. |
| 81 | 30 | Presence | 1 | 2.5 | A | A | A | Inv. |
| 82 | 31 | Presence | 1 | 2.5 | A | A | A | Inv. |
| 83 | 32 | Presence | 1 | 2.5 | B | B | A | Inv. |
| 84 | 33 | Presence | 1 | 2.5 | A | A | A | Inv. |
| 85 | 34 | Presence | 1 | 2.5 | A | A | A | Inv. |
| 86 | 1 | Absence | 2 | 2.5 | A | A | B | Inv. |
| 87 | 2 | Absence | 2 | 2.5 | B | B | B | Inv. |
| 88 | 3 | Absence | 2 | 2.5 | C | C | C | Comp. |
| 89 | 4 | Absence | 2 | 2.5 | A | A | B | Inv. |
| 90 | 5 | Absence | 2 | 2.5 | B | B | B | Inv. |
| 91 | 6 | Absence | 2 | 2.5 | C | C | C | Comp. |
| 92 | 7 | Absence | 2 | 2.5 | A | A | B | Inv. |
| 93 | 8 | Absence | 2 | 2.5 | B | B | B | Inv. |
| 94 | 9 | Absence | 2 | 2.5 | C | C | C | Comp. |
| 95 | 10 | Absence | 2 | 2.5 | C | C | C | Comp. |
| 96 | 11 | Absence | 2 | 2.5 | A | A | B | Inv. |
| 97 | 12 | Absence | 2 | 2.5 | A | A | B | Inv. |
| 98 | 13 | Absence | 2 | 2.5 | A | A | B | Inv. |
| 99 | 14 | Absence | 2 | 2.5 | A | A | B | Inv. |
| 100 | 15 | Absence | 2 | 2.5 | A | A | B | Inv. |
| 101 | 16 | Absence | 2 | 2.5 | A | A | B | Inv. |
| 102 | 17 | Absence | 2 | 2.5 | A | A | B | Inv. |

From the results in Table 4, it is proved that the printed image formed by using thermally transferable dyes having characteristics defined by Formula (1) of this invention, is superior in light stability and bleeding resistance compared to the comparative samples, as same as Example 1, even though the printing rate is enhanced. Further, it is proved that by provision of a transferable protective layer, abrasion resistance is enhanced without impairing light stability and bleeding resistance.

Example 3

Image Forming Method 3

The image receiving layer portion of Image Receiving Sheet 1 prepared in Example 1 and the ink layer portions of Thermal Transfer Sheets 2, 5, 8, and 15 prepared in Example 1 were superimposed and set in a thermal transfer apparatus fitted with a 300 dpi (hereinafter dpi represents the number of dots per inch, being 2.54 cm) line thermal head in which the resistor shape was rectangular (having a length in the primary scanning direction of 80 μm×a length in the secondary scanning direction of 120 μm). While the thermal head was being brought into pressure contact with the platen roller, dyes were transferred onto the image receiving layer while heating the reverse side of the ink layer at a feed rate of 2.5 msec./line and a feed length per line of 85 μm in such a neutral step pattern (being a three color surprint of yellow, magenta and cyan) that applied energy was successively increased in the range of 5–80 mJ/mm$^2$, whereby Printed Samples 103–106 were prepared. However, when the neutral step patter was prepared, the cyan ink layer was firstly printed, and subsequently the magenta ink layer was printed and finally the yellow ink layer was printed.

Subsequently, Printed samples 111–14 were prepared in the same manner, except that Image Receiving Sheet 1 was changed to Image Receiving Sheet 2.

Subsequently, Printed samples 107–110 were prepared in the same manner as above, using Image Receiving Sheet 1 and Thermal Transfer Sheets 19, 22, 25, and 32 having a transferable protective layer, in the printing order of a cyan ink layer first, a magenta ink layer second and finally a yellow ink layer, and then the transparent protective layer was transferred onto the image receiving layer as the transferable transparent protective layer was heated from the rear side of the substrate.

Regarding the obtained Printed samples, evaluation of light stability, background whiteness and adhesiveness of protective layer was conducted in the same manner as Example 1. Obtained results are shown in Table 5.

TABLE 5

| Printed sample | Thermal transfer sheet | Protective layer presence/absence | Image receiving sheet | Printing rate msec/line | Light stability | Bleeding resistance | Abrasion resistance |
|---|---|---|---|---|---|---|---|
| 103 | 2 | absence | 1 | 2.5 | A | B | B |
| 104 | 5 | absence | 1 | 2.5 | A | B | B |
| 105 | 8 | absence | 1 | 2.5 | A | B | B |
| 106 | 15 | absence | 1 | 2.5 | A | B | B |
| 107 | 19 | presence | 1 | 2.5 | A | B | A |
| 108 | 22 | presence | 1 | 2.5 | A | B | A |
| 109 | 25 | presence | 1 | 2.5 | A | B | A |
| 110 | 32 | presence | 1 | 2.5 | A | B | A |
| 111 | 2 | absence | 2 | 2.5 | A | B | B |
| 112 | 5 | absence | 2 | 2.5 | A | B | B |
| 113 | 8 | absence | 2 | 2.5 | A | B | B |
| 114 | 15 | absence | 2 | 2.5 | A | B | B |

From the results in Table 5, it is proved that the printed image which is obtained by printing the ink layer first, which ink layer contains a thermally transferable due having the smallest value of Aa/Am×100 defined by Formula (1) of this invention, exhibits much enhanced light stability.

What is claimed is:

1. An image forming method comprising the steps of:

(a) forming an image on a thermal transfer sheet of a thermal transfer recording material, and (b) transferring the image onto an image receiving sheet of the thermal transfer recording material, wherein the thermal transfer sheet comprising a substrate having thereon a yellow ink layer containing a thermally transferable yellow dye, a magenta ink layer containing a thermally transferable magenta dye, and a cyan ink layer containing a thermally transferable cyan dye, the image receiving sheet comprising a substrate having thereon a thermally transferable dye receiving layer containing a dye fixing agent;

at least one of the thermally transferable dyes is reactive with the dye fixing agent, and satisfies Formula (1):

$$(Aa/Am)\times 100 \geqq 75 \qquad \text{Formula (1)}$$

wherein Am is an absorbance at a wavelength of an absorption maximum ($\lambda max_1$) obtained by adding 30 mol of the dye fixing agent to 1 mol of the thermally transferable dye, and Aa is an absorbance at wavelength of an absorption maximum ($\lambda max_1$) obtained by adding 3 mol of the dye fixing agent to 1 mol of the thermally transferable dye; and a printing rate of each of the yellow ink layer, the magenta ink layer and the cyan ink layer is not more than 2.5 msec. /line; and wherein one of the thermally transferable cyan dyes is reactive with a dye fixing agent, and satisfies Formula (1).

2. The image forming method of claim 1, wherein a thermally transferable protective layer is further provided on the substrate.

3. The image forming method of claim 2, wherein (Aa/Am)×100 defined by Formula (1) is 90 or more.

4. The image forming method of claim 2, wherein the thermally transferable protective layer contains an ultraviolet ray absorbing agent.

5. The image forming method of claim 1, wherein (Aa/Am)×100 defined by Formula (1) is 90 or more.

6. The image forming method of claim 1, wherein one of the thermally transferable magenta dyes is reactive with a dye fixing agent, and satisfy Formula (1).

7. The image forming method of claim 1, wherein one of the thermally transferable yellow dyes, and one of the thermally transferable magenta dyes are each reactive with a dye fixing agent, and satisfy Formula (1).

8. The image forming method of claim 1, wherein at least one of the ink layers is reactive with a dye fixing agent, and contains at least two kinds of dyes, one of which is the thermally transferable cyan dye satisfying Formula (1).

9. The image forming method of claim 1, wherein (a) the yellow dye is a compound represented by formulas Y-6 or Y-7 below,

Y-6

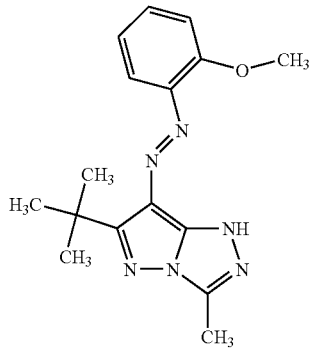

Y-7

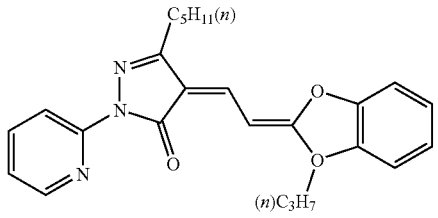

(b) the magenta dye is a compound represented by formulas M-5, M-6, M-7 or M-8, below,
M-5
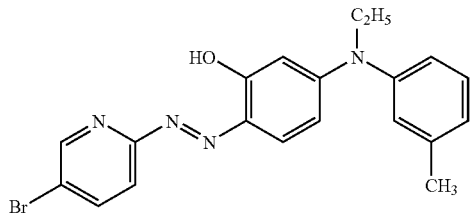
M-6
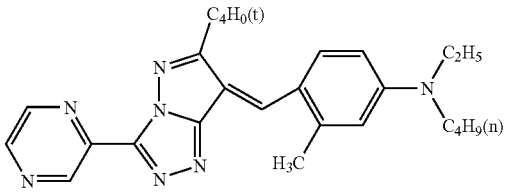
M-7
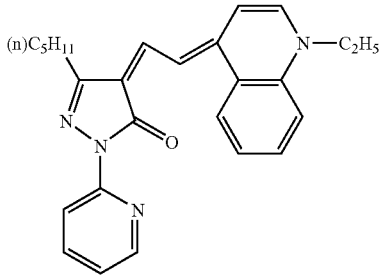
M-8
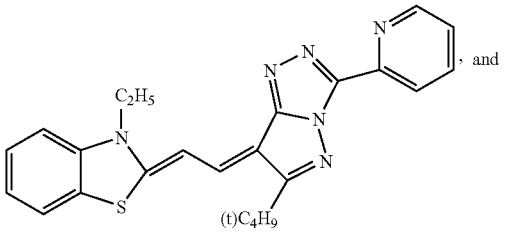
, and
(c) the cyan dye is a compound represented by formulas C-5, C-6, C-9, C-10 or C-11, below.
C-5
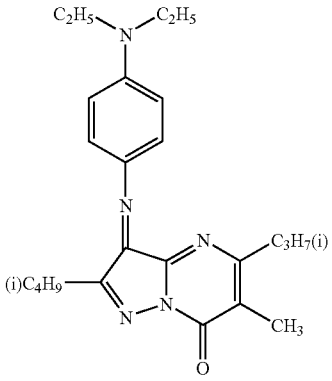
-continued
C-6
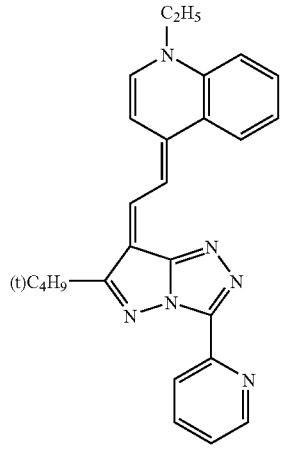
C-9
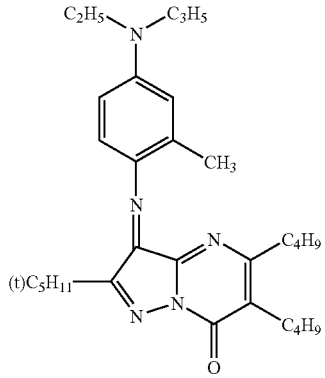
C-10
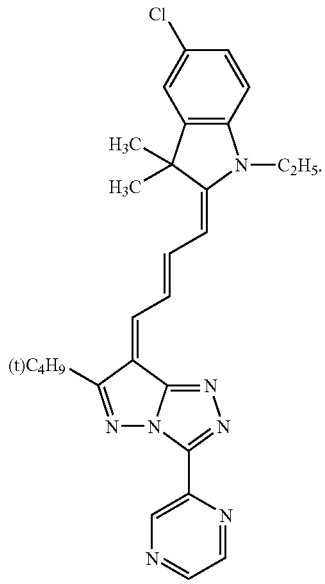

-continued

C-11

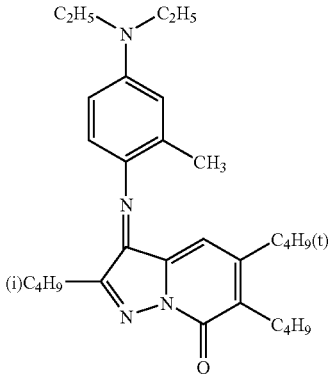

10. An image forming method comprising the steps of:

(a) forming an image on a thermal transfer recording material comprising a thermal transfer sheet, and (b) transferring the image onto an image receiving sheet, wherein the thermal transfer sheet comprising a substrate having thereon a yellow ink layer containing a thermally transferable yellow dye, a magenta ink layer containing a thermally transferable magenta dye, and a cyan ink layer containing a thermally transferable cyan dye, the image receiving sheet comprising a substrate having thereon a thermally transferable dye receiving layer containing a dye fixing agent;

at least one of the thermally transferable dyes is reactive with the dye fixing agent, and satisfies Formula (1):

$$(Aa/Am)\times 100 \geqq 75 \qquad \text{Formula (1)}$$

wherein Am is an absorbance at a wavelength of an absorption maximum ($\lambda max_1$) obtained by adding 30 mol of the dye fixing agent to 1 mol of the thermally transferable dye, and Aa is an absorbance at a wavelength of an absorption maximum ($\lambda max_1$) obtained by adding 3 mol of the dye fixing agent to 1 mol of the thermally transferable dye; and the image is formed by sequential printing onto the ink layer in the order of the value of (Aa/Am)×100 defined by Formula (1), with the smallest value ink layer being first; and wherein one of the thermally transferable cyan dyes is reactive with a dye fixing agent, and satisfies Formula (1).

11. The image forming method of claim 10, wherein a thermally transferable protective layer is further provided on the substrate.

12. The image forming method of claim 11, wherein the thermal transferable protective layer contains an ultraviolet ray absorbing agent.

13. The image forming method of claim 10, wherein at least one of the ink layers is reactive with a dye fixing agent, and contains at least two kinds of dyes, one of which is the thermally transferable cyan dye satisfying Formula (1).

14. The image forming method of claim 10, wherein:

(a) the yellow dye is a compound represented by formulas Y-6 or Y-7 below,

Y-6

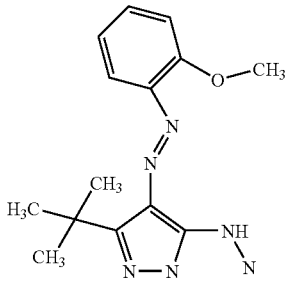

Y-7

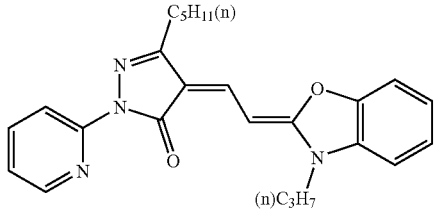

(b) the magenta dye is a compound represented by formulas M-5, M-6, M-7 or M-8, below,

M-5

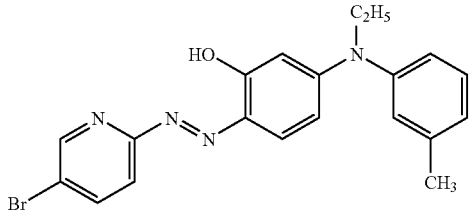

M-6

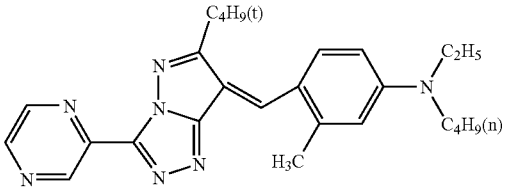

M-7

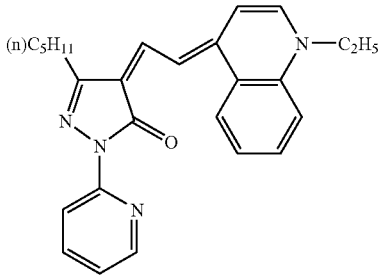

M-8

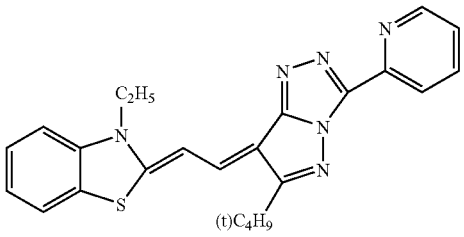

, and (c) the cyan dye is a compound represented by formulas C-5, C-6, C-9, C-10 or C-11, below,

C-5

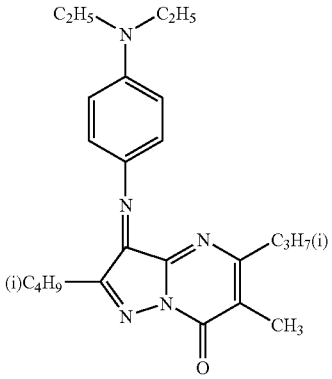

C-6

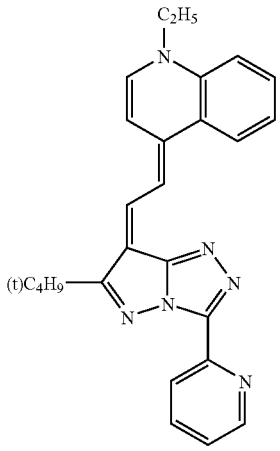

C-9

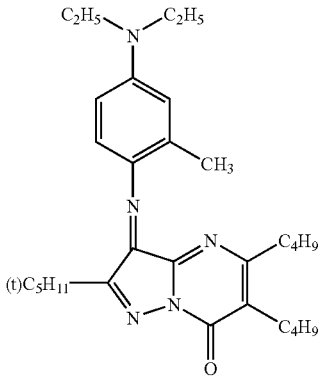

-continued

C-10

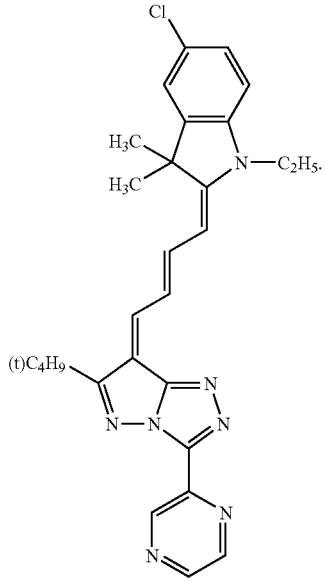

C-11

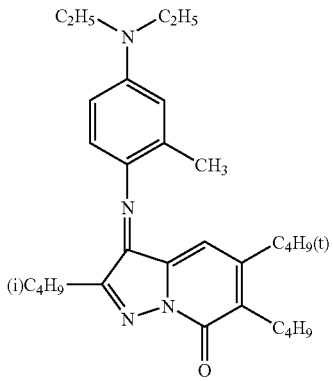

15. An image forming method comprising the steps of:

(a) forming an image on a thermal transfer recording material comprising a thermal transfer sheet, and (b) transferring the image onto an image receiving sheet, wherein the thermal transfer sheet comprising a substrate having thereon a yellow ink layer containing a thermally transferable yellow dye, a magenta ink layer containing a thermally transferable magenta dye, and a cyan ink layer containing a thermally transferable cyan dye, the image receiving sheet comprising a substrate having thereon a thermally transferable dye receiving layer containing a dye fixing agent;

at least one of the thermally transferable dyes is reactive with the dye fixing agent, and satisfies Formula (1):

$$(Aa/Am)\times 100 \geqq 75 \qquad \text{Formula (1)}$$

wherein Am is an absorbance at a wavelength of an absorption maximum ($\lambda max_1$) obtained by adding 30 mol of the dye fixing agent to 1 mol of the thermally transferable dye, and Aa is an absorbance at a wavelength of an absorption maximum ($\lambda max_1$) obtained by adding 3 mol of the dye fixing agent to 1 mol of the thermally transferable dye;

a printing rate of each of the yellow ink layer, the magenta ink layer and the cyan ink layer is not more than 2.5 msec./line; and the image is formed by sequential printing on the ink layer in the order of the value of (Aa/Am)×100 defined by Formula (1), with the smallest value ink layer being first; and wherein one of the thermally transferable cyan dyes is reactive with a dye fixing agent, and satisfies Formula (1).

16. The image forming method of claim 15, wherein a thermally transferable protective layer is further provided on the substrate.

17. The image forming method of claim 16, wherein a thermally transferable protective layer contains an ultraviolet ray absorbing agent.

18. The image forming method of claim 15, wherein at least one of the ink layers contains at least two kinds of the thermally transferable dyes which are reactive with a dye fixing agent and are satisfying Formula (1), one of which is the thermal transferable cyan dye satisfying Formula 1.

* * * * *